US006575560B2

(12) United States Patent
Kaneko et al.

(10) Patent No.: US 6,575,560 B2
(45) Date of Patent: Jun. 10, 2003

(54) LIQUID DISCHARGE RECORDING HEAD AND LIQUID DISCHARGE RECORDING APPARATUS

(75) Inventors: Mineo Kaneko, Tokyo (JP); Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,256

(22) Filed: Jul. 6, 2001

(65) Prior Publication Data

US 2002/0021326 A1 Feb. 21, 2002

(30) Foreign Application Priority Data

Jul. 10, 2000 (JP) ..... 2000-209091

(51) Int. Cl.[7] ..... B41J 2/25
(52) U.S. Cl. ..... 347/43; 347/15
(58) Field of Search ..... 347/43, 15, 12, 347/40, 41

(56) References Cited

U.S. PATENT DOCUMENTS 4,528,576 A 7/1985 Koumura et al. ..... 347/43
6,267,468 B1 * 7/2001 Torgerson et al. ..... 347/43

FOREIGN PATENT DOCUMENTS

EP 0 244 643 11/1987
EP 0 914 948 A 5/1999
EP 0 955 174 A 11/1999
EP 1 110 743 A 6/2001
JP 62-264957 11/1987

OTHER PUBLICATIONS

Patent Abstracts of Japan, vol. 008, No. 069 (M–286), Mar. 31, 1984 (JP 58 215352, Dec. 14, 1983).

* cited by examiner

*Primary Examiner*—Lamson Nguyen
(74) *Attorney, Agent, or Firm*—Fitzpatrick, Cella, Harper & Scinto

(57) ABSTRACT

A liquid discharge recording head, comprising a plurality of orifice strings each having a plurality of orifices arranged correspondingly to respective recording liquids for discharging the recording liquids of a plurality of colors, a plurality of liquid flow paths and electrical heat converting elements corresponding to the plurality of orifices, and a plurality of liquid supplying apertures arranged along the orifice strings for supplying the recording liquids of the plurality of colors to the plurality of liquid flow paths, wherein the orifice strings corresponding to the recording liquids of the plurality of colors are symmetrically arranged about the head scanning direction regarding the same color of the recording liquids and the head has a plurality of chambers having communication with the liquid flow paths in the opposite side of the orifice strings with the liquid supplying apertures therebetween.

28 Claims, 18 Drawing Sheets

LIQUID DISCHARGE RECORDING HEAD AND LIQUID DISCHARGE RECORDING APPARATUS

BACKGROUND OF THE INVENTION

1. Field of the Invention

The present invention relates to a liquid discharge recording head for applying a plurality of different types of liquids such as ink of a plurality of colors to paper or other record mediums and a liquid discharge recording apparatus with the liquid discharge recording head mounted thereon for printing.

2. Related Background Art

A printer, particularly an ink-jet recording type printer is capable of outputting high-quality characters or images at low cost, thus rapidly spreading in office or home applications. Some products enable a black-character quality, a density, and a water resistance equivalent to those of commercial prints in text outputs. As far as images, there appeared products realizing colors and gradations equivalent to a silver gelatin (salt) print. In future, a lower cost and a high-speed output will be demanded as well as the above performances.

SUMMARY OF THE INVENTION

Referring to FIG. 19, there is shown a perspective view partially exploded for an explanation of a configuration of a general color-ink-jet recording head. A base 218 has three through holes (liquid supplying apertures) 219 formed thereon, to which ink of cyan, magenta, and yellow is supplied. The top surface of the base is covered with a nozzle formation member 223, in which ink flow path strings are formed in contact with respective through holes 219, electrical heat converting elements 220 are formed at the bottoms of the ink flow paths on the top surface of the base, and further orifices 224 are formed correspondingly to the electrical heat converting elements. In color recording by using an ink-jet recording head having this base, the head scans a record medium concurrently with attaching ink to the record medium in an order of cyan, magenta, and yellow and an image is formed by repeating this operation. While the head moves backward on the record medium, discharging in the arrangement order causes the order of colors to be reversed on the record medium and results in a hue change, thereby causing color-shading. Although it can be prevented by separating the arrangement order from the discharging order, it is not advantageous in high-speed recording. In addition, while it is necessary to increase a record frequency by increasing the number of orifices for high-speed recording, it increases an ink flow rate per unit time in the inside of the through hole and a pressure fluctuation in the inside thereof, thus giving unfavorable vibrations to a meniscus at the orifice. Particularly to increase the discharge frequency, there is a method of decreasing a flow path resistance, for example, by shortening the flow path to increase an ink moving speed in the ink flow path, while it also causes the vibrations of the meniscus at the orifice to be more sensitive to a pressure fluctuation inside the through hole. This problem will be serious in an area having a small droplet quantity of 10 pl (picoliters, 10 to 12 liters) or lower.

In view of these problems, it is a primary object of the present invention to provide a recording head capable of providing high-speed color reciprocating printing free from color-shading in the minimum base size, wherein the recording head is a liquid discharge recording head capable of maintaining a high-quality image by attenuating a pressure fluctuation inside the liquid supplying aperture at the liquid discharge and to provide a liquid discharge recording apparatus having the recording head.

According to one aspect, the present invention which achieves these objects related to a liquid discharge recording head comprising a plurality of orifice strings each having a plurality of orifices arranged correspondingly to respective recording liquids for discharging recording liquids of a plurality of colors, a plurality of liquid flow paths and electrical heat converting elements corresponding to the plurality of orifices, and a plurality of liquid supplying apertures arranged along the orifice strings for supplying the recording liquids of the plurality of colors in the plurality of liquid flow paths, wherein each of the orifice strings corresponding to the recording liquids of the plurality of colors is symmetrically arranged about a head scanning direction regarding the same color of the recording liquid and the head has a plurality of chambers having communication with the liquid flow paths in the opposite side of the orifice strings with the liquid supplying apertures therebetween. According to this arrangement, the color order for implanting droplets in a record medium is the same for recording in both forward and backward direction, thereby preventing color-shading and reducing a pressure fluctuation inside the through holes effectively, by which high-speed bidirectional recording can be performed.

The above recording head preferably has an odd number of the liquid supplying apertures and an even number of the orifice strings, with the middle liquid supplying aperture among the plurality of liquid supplying apertures disposed between the orifices, the electrical heat converting elements, and the liquid flow paths and with other liquid supplying apertures having orifices, electrical heat converting elements, and liquid flow paths in a single side of the other liquid supplying apertures.

In this condition, the orifice strings (lines), the electrical heat converting elements, and the liquid flow paths are disposed almost line-symmetrically about the middle liquid supplying apertures.

In this manner, by disposing the liquid supplying apertures other than the middle one among the plurality of liquid supplying apertures for supplying liquids to the plurality of liquid flow path strings (lines), the orifice strings, the heat resistance elements, the liquid flow paths, and driver circuits so as to have line symmetry about the middle ink supplying apertures, the liquid supplying apertures and the driver circuits can be disposed at regular intervals on the base efficiently, thus minimizing the base size. The reduction of the base size decreases a capacity of a memory for retaining transfer data to the recording head proportionally to the base size, thus enabling the cost to be lowered.

Furthermore, in the above recording head, preferably the ith orifices counted from each end of the orifice strings belonging to a left half or a right half of the middle liquid supplying apertures are disposed on a single line and the ith orifice in the left half and the ith orifice in the right half are disposed with a difference by a half pitch in the column direction. This enables printing of high precision and fineness which is substantially twice those of the orifice array pitch.

Particularly, in the above liquid discharge recording head, the present invention comprises a plurality of chambers (hereinafter, referred to as buffer chambers) having communication with the liquid flow paths in the opposite side of the orifices about the liquid supplying apertures on the same plane as for the liquid flow paths in contact with the liquid supplying apertures. According to this arrangement, an air easily remains in the buffer chambers even in a condition in which the liquid supplying apertures and the liquid flow paths are filled with liquids, thereby enabling an attenuation of pressure fluctuations inside the liquid supplying apertures caused by discharging droplets. This reduces a meniscus vibration at driving a discharge, thereby enabling a high-quality image to be maintained.

In this recording head, the number of the buffer chambers is preferably the same as the number of the liquid flow paths. In addition, preferably a pitch of the buffer chambers adjacent to each other is the same as a pitch of the liquid flow paths adjacent to each other and the buffer chambers are opposite to the liquid flow paths and disposed with a half-pitch difference relative to the liquid flow paths. A shape of the buffer chamber is preferably almost the same as that of the liquid flow path.

Furthermore, in the above head, preferably there are at least three colors of cyan, magenta, and yellow for the plurality of liquid colors with the yellow ink supplied to the middle liquid supplying aperture among the plurality of liquid supplying apertures.

The buffer chambers may have communication with the liquid supplying apertures other than the middle liquid supplying aperture. In addition, the buffer chambers may form grooves each having a desired shape in a portion in contact with the middle liquid supplying aperture of a member forming the liquid flow paths and may be formed by covering these grooves with a thin film member.

Furthermore, the liquid flow paths and the buffer chambers may be formed by coating the base with a positive photosensitive resin, exposing and developing it to shapes of molds of the liquid flow paths and the buffer chambers, coating it with a negative photosensitive resin, and then removing the positive photosensitive resin.

In addition, the present invention includes a liquid discharge recording apparatus, which has a carriage for detachably mounting the liquid discharge recording head, for recording on a record medium by discharging droplets from a desired orifice string of the liquid discharge recording head with a scanning of the carriage.

DETAILED DESCRIPTION OF THE PREFERRED EMBODIMENTS

The preferred embodiments of the present invention will now be described hereinafter with reference to the accompanying drawings.

Referring to FIG. 1 to FIG. 8, there are shown explanatory diagrams for describing preferred head cartridges, recording heads, and ink tanks and their relations according to the present invention, respectively. Hereinafter, their components will be described on the basis of these drawings.

Figure 2:
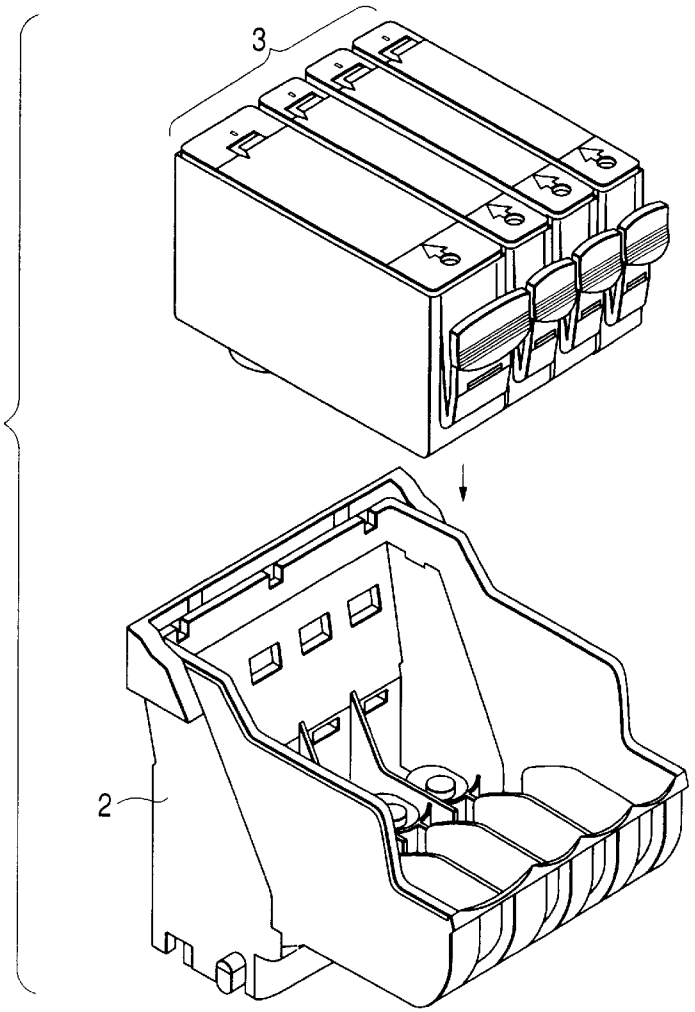
FIG. 2 is a perspective view showing a recording head and ink tanks forming the recording head cartridge in FIG. 1.
Figure 1:
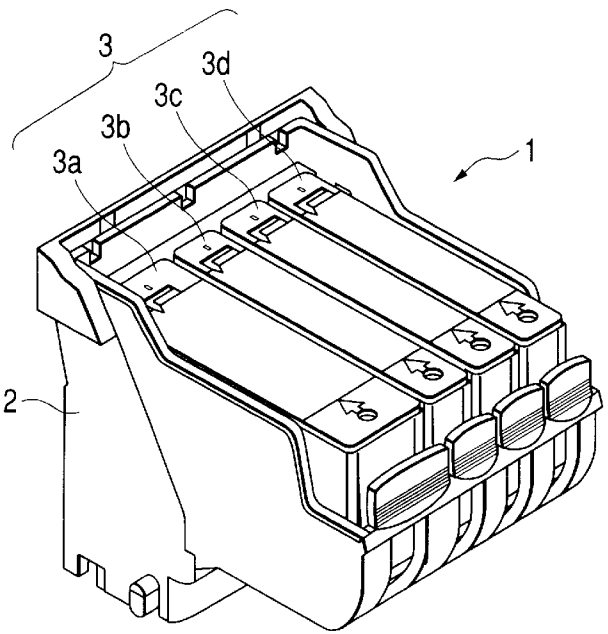
FIG. 1 is a perspective view showing an example of a recording head cartridge to which the present invention is applicable.

As shown in FIG. 1 and FIG. 2, a recording head cartridge 1 according to this embodiment comprises a recording head 2 and ink tanks 3 (3*a*, 3*b*, 3*c*, and 3*d*) detachably mounted on the recording head 2. This recording head cartridge 1 is fixed and supported by a positioning unit of a carriage (not shown) mounted on an ink-jet recording apparatus and electrical contacts and detachably mounted on the carriage. The ink tanks 3*a*, 3*b*, and 3*c* are used for black ink, cyan ink, magenta ink, and yellow ink, respectively. In this manner, each of the ink tanks 3*a*, 3*b*, 3*c*, and 3*d* is detachably mounted on the recording head unit 2, so that each of the ink tanks is exchangeable, thus reducing a running cost of printing in the ink-jet recording apparatus.

Next, the recording head 2 is described in more detail by giving an explanation of components forming the recording head in order.

(1) Recording Head

For the recording head 2, there is used a recording head which is a side shooter type in a bubble-jet process for recording by using electrical heat converting elements for generating heat energy causing film boiling in response to an electric signal on ink.

The recording head 2 comprises a recording element unit 4, an ink supplying unit 5, and a tank holder 6.

Figure 3:
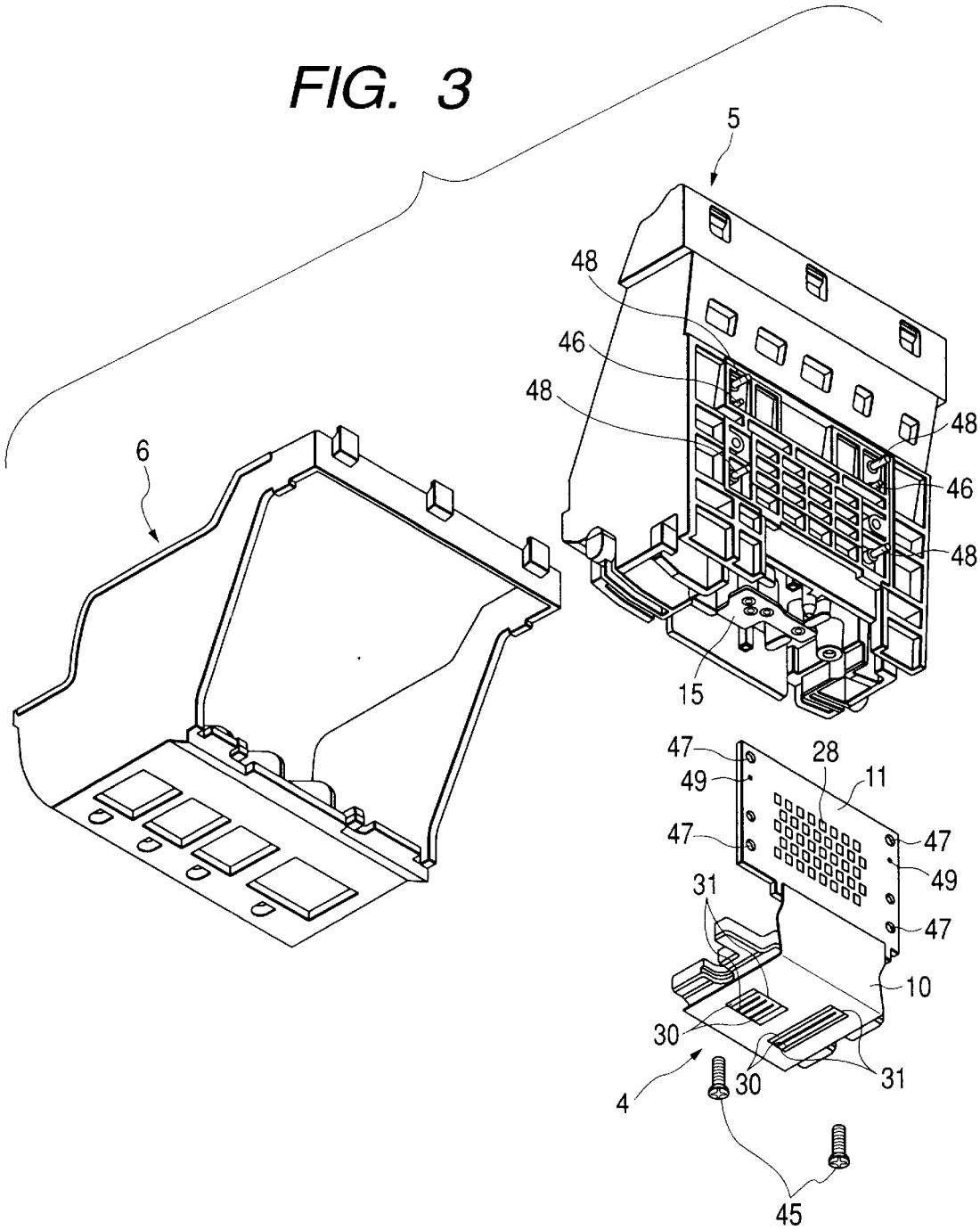
FIG. 3 is an exploded perspective view of the recording head forming the recording head cartridge in FIG. 1.
Figure 4:
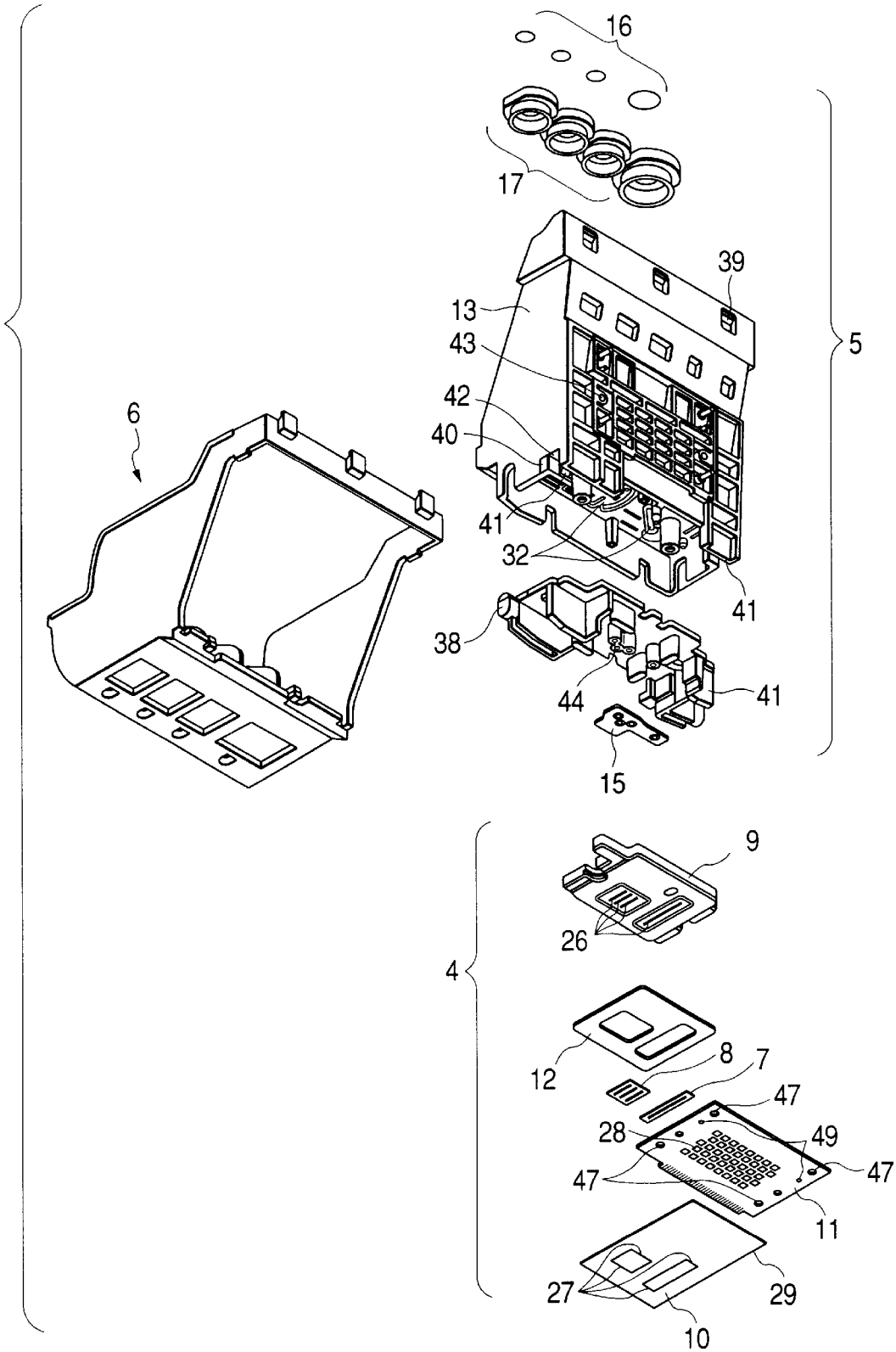
FIG. 4 is a detailed exploded perspective view of the recording head forming the recording head cartridge in FIG. 1.

In addition, as shown in exploded perspective views in FIG. 3 and FIG. 4, the recording element unit 4 comprises a first recording element base 7, a second recording element base 8, a first plate 9, an electrical wiring tape 10, an electrical contact base 11, and a second plate 12 and the ink supplying unit 5 comprises an ink supplying member 13, a flow path forming member 14, a joint rubber 15, a filter 16, and a seal rubber 17.

[Recording Element Unit]

Figure 5:
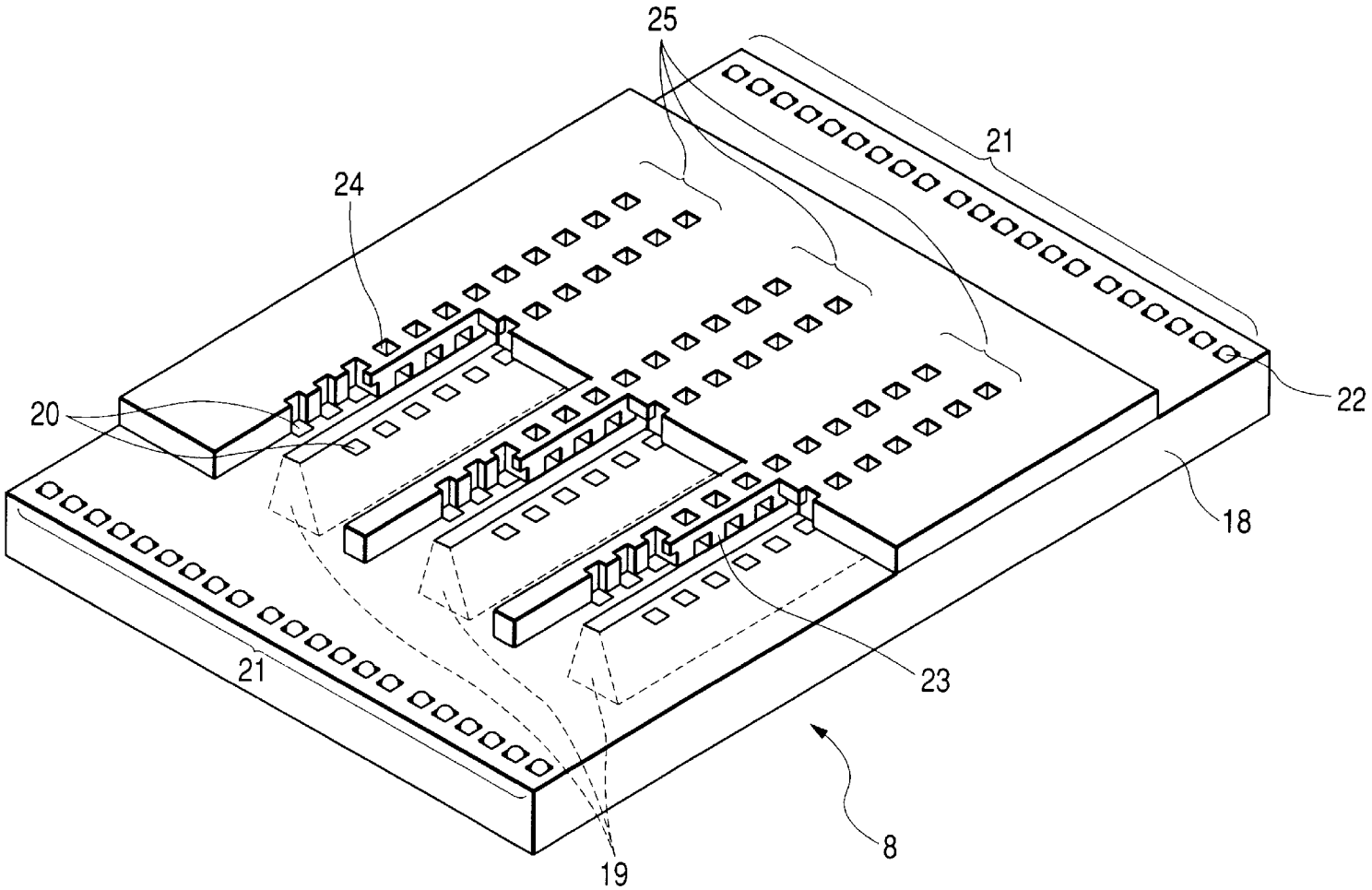
FIG. 5 is a diagram of assistance in explaining the configuration of a first recording element base shown in FIG. 3.

Referring to FIG. 5, there is shown a perspective view partially exploded for an explanation of a configuration of the first recording element base 7. The first recording element base 7 has, for example, an Si base 18 having a thickness of 0.5 to 1 mm on which ink supplying apertures 19 formed by long-grooved through holes are formed as ink flow paths in a method of an anisotropic etching using an Si crystal direction or of sandblasting, with each of the ink supplying apertures disposed between two strings (lines) of the electrical heat converting elements 20 in a hound's-tooth check-like arrangement and with Al or other electrical wiring formed by a film formation technology. Furthermore, electrode portions 21 for supplying power to the electrical wiring are disposed in both external sides of the electrical heat converting elements 20 and Au or other bumps 22 are formed in the electrode portions 21. On the Si base, ink flow path walls 23 and orifices 24 for forming the ink flow paths corresponding to the electrical heat converting elements 20 are made of a resin material by using a photolithography technology to form orifice groups 25. Therefore, the orifices 24 are arranged so as to be opposed to the electrical heat converting elements 20 and therefore ink supplied from the ink supplying aperture 19 is discharged with bubbles generated in the ink by giving a heat energy from the electrical heat converting elements 20.

The second recording element base 8, which will be described in detail later, is a recording element base for discharging ink of three colors with the ink supplying apertures 19 formed in parallel as shown in FIG. 5 and with each of the ink supplying apertures between strings of the electrical heat converting elements 20 and the ink orifices 24. Naturally in the same manner as for the first recording element base 7, ink supplying apertures, electrical heat converting elements, electrical wiring, and electrode portions are formed on an Si base and ink flow paths and ink orifices are formed thereon by a resin material in the photolithography technology.

Additionally in the same manner as for the first recording element base 7, Au or other bumps 22 are formed in the electrode portions 21 for supplying power to the electrical wiring. Next, the first plate 9 is made of, for example, an aluminum oxide ($Al_2O_3$) material having a thickness of 0.5 to 10 mm. The material of the first plate 9 is not limited to the aluminum oxide, but may be a material having a linear expansion coefficient equivalent to that of the material of the recording element base 7, 8 and a heat conductivity equivalent to or higher than that of the material of the recording element base 7, 8. The material of the first plate 9 can be any of silicon (Si), aluminum nitride (AlN), zirconium oxide, silicon nitride ($Si_3N_4$), silicon carbide (SiC), molybdenum (Mo), and tungsten (W). The first plate 9 has ink supplying apertures 26 for supplying a black ink to the first recording element base 7 and ink supplying apertures 26 for supplying ink of cyan, magenta, and yellow to the second recording element base 8 formed on the first plate, and the ink supplying apertures 19 on the recording element bases 7 and 8 correspond to the ink supplying apertures 26 on the first plate 9, respectively, and the first recording element base 7 and the second recording element base 8 are bonded to be fixed to the first plate 9 at a high positional precision, respectively. Preferably a first adhesive used for the bonding has a low viscosity, a low hardening temperature so as to be hardened in a short time, relatively high hardness after the hardening, and a resistance to ink. The first adhesive is preferably, for example, a heat-hardening adhesive whose principal element is, for example, an epoxy and the thickness of its bonding layer is 50 $\mu$m or lower.

The electrical wiring tape 10 is used for applying an electric signal for discharging ink to the first recording element base 7 and the second recording element base 8 and comprises a plurality of opening portions for incorporating the recording element bases, electrode terminals 27 corresponding to the electrode portions 21 of the recording element bases, and an electrode terminal portion 29, which is located in an end portion of the wiring tape 10, for an electrical connection with the electrical contact base 11 having an external signal input terminal 28 for receiving the electric signal from the apparatus, with the electrode terminal 27 connected to the electrode terminal portion 29 through a continuous copper foil wiring pattern.

The electrical wiring tape 10, the first recording element base 7, and the second recording element base 8 are electrically connected to each other in such a way, for example, that the electrode portion 21 of the recording element base is electrically joined to the electrode terminal 27 on the electrical wiring tape 10 in the heat ultrasonic contact bonding process.

The second plate 12 is, for example, a sheet of plate member having a thickness of 0.5 to 1 mm and is made of, for example, aluminum oxide ($Al_2O_3$) or other ceramic or Al, SUS, or other metallic materials. Additionally it has opening portions larger than external dimensions of the first recording element base 7 and the second recording element recording base 8 bonded and fixed to the first plate 9. Furthermore, the first recording element base 7, the second recording element base 8, and the electrical wiring tape 10 are bonded to the first plate 9 with a second adhesive so that they can be electrically connected to each other on a plane and a back of the electrical wiring tape 10 is bonded and fixed with a third adhesive.

The electrically connected portions between the first recording element base 7, the second recording element base 8, and the electrical wiring tape 10 are sealed by a first sealer and a second sealer (not shown) to protect the electrically connected portions from a corrosion caused by ink or an external shock. The first sealer is mainly used for sealing in the rear of the connected portion between the electrode terminal 27 of the electrical wiring tape 10 and the electrode portion 21 of the recording element base and in the outer peripheral portion and the second sealer is used for sealing in the face of the connected portion. Furthermore, the electrical contact base 11 having the external signal input terminal 28 for receiving an electric signal from the apparatus at the end of the electrical wiring tape 10 is electrically connected by heat contact bonding using an anisotropic conductive film or the like.

Then, the electrical wiring tape 10 is folded in a single side of the first plate 9 and bonded by the third adhesive on the side of the first plate 9. The third adhesive is, for example, a heat-hardening adhesive having a thickness of 10 to 100 $\mu$m whose principal element is an epoxy.

[Ink Supplying Unit]

The ink supplying member 13 is formed by, for example, a resin mode. The resin material preferably contains glass filler by 5 to 40% to increase rigidity in shape.

Figure 6:
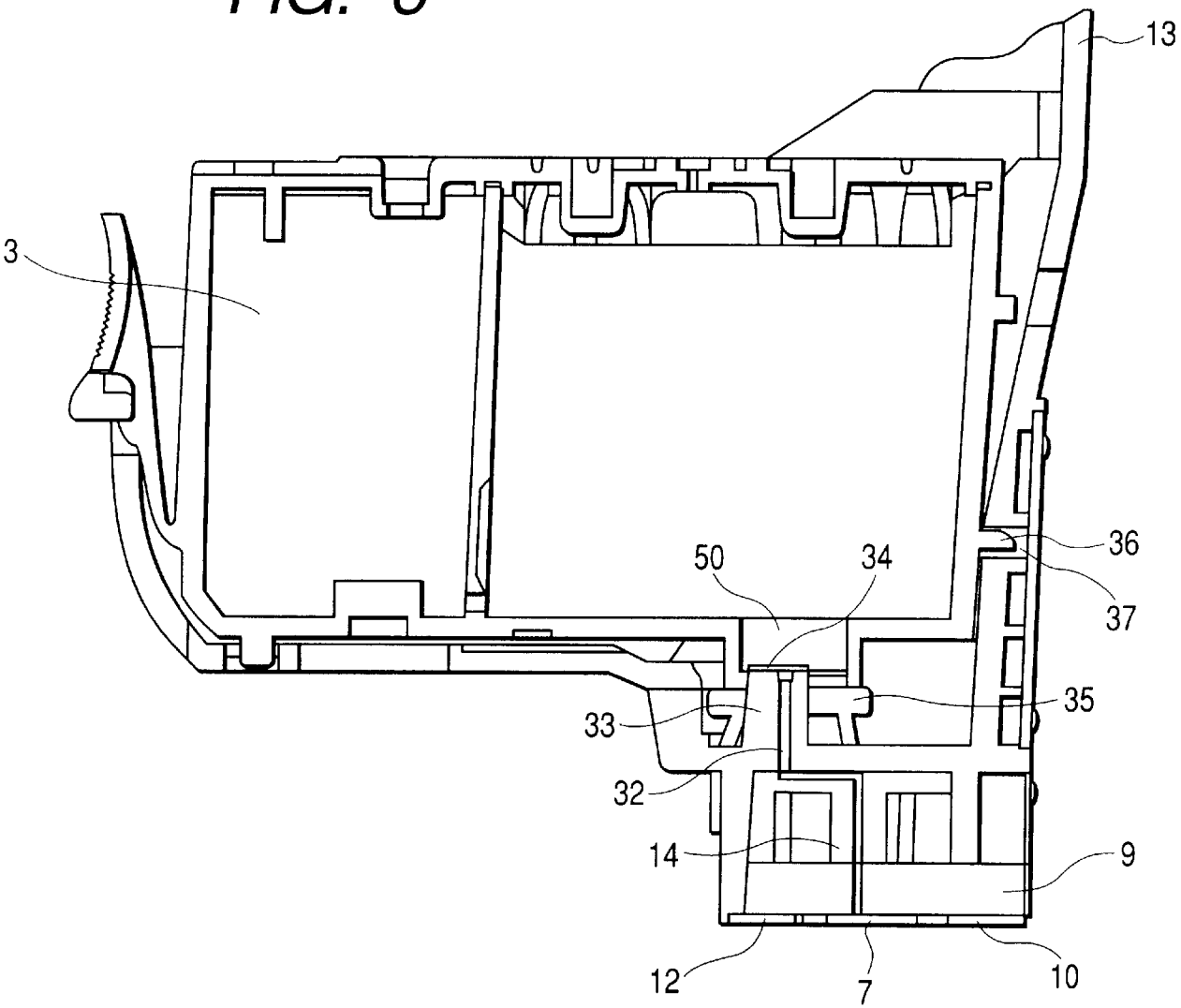
FIG. 6 is a cross section showing a connecting status of the recording head and the ink tanks shown in FIG. 2.

As shown in FIG. 3, FIG. 4, and FIG. 6, the ink supplying member 13 is a component of the ink supplying unit 5 for guiding ink from the ink tank 3 to the recording element unit 4, with ink flow paths 32 formed by ultrasonic solvent welding of the flow path forming member 14. A joint portion 33 for engaging with the ink tank 3 is jointed to a filter 34 to prevent a mixture of rubbish from the outside and further a seal rubber 35 is mounted to prevent ink from evaporating from the joint portion 33.

In addition, the ink supplying member 13 partially has a function of holding the detachably-mounted ink tank 3, thus having a first aperture 37 for an engagement of a second click 36 of the ink tank 3.

The ink supplying member 13 comprises a mounting guide 38 for guiding the recording head cartridge 1 to a mounting position of the carriage (not shown) of the ink-jet recording apparatus, an engaging portion 39 for mounting and fixing the recording head cartridge 1 to the carriage (not shown) by a headset lever, a butting portion 40 in an X direction (in the carriage scanning direction) for positioning in a predetermined mounting position of the carriage, a butting portion 41 in a Y direction (in the recording media conveying direction), and a butting portion 42 in a Z direction (in the ink discharge direction). Additionally, it has a terminal fixing portion 43 for positioning and fixing the electrical contact base 11 of the recording element unit 4, with a plurality of ribs provided in the terminal fixing portion 43 and its surroundings to increase rigidity of a surface having the terminal fixing portion 43.

[Connection Between Recording Head Unit and Ink Supplying Unit]

As shown in FIG. 3 in the above, the recording head 2 is completed by connecting the recording element unit 4 to the ink supplying unit 5 and further to the tank holder 6. They are connected as described below.

An ink supplying aperture (the ink supplying aperture 26 of the first plate 9) of the recording element unit 4 and an ink supplying aperture (the ink supplying aperture 44 of the flow path forming member 14) of the ink supplying unit 5 are fixed with machine screws 45 via a joint rubber 15 so that these members are contact-bonded in order to enable the members to have communication with each other, being free from a leakage of ink. Simultaneously with this fixing, the recording element unit 4 is accurately positioned and fixed at the reference position in the X, Y, and Z directions of the ink supplying unit 5.

Then, the electrical contact base 11 of the recording element unit 4 is positioned and fixed to a single side of the ink supplying member 13 by terminal positioning pins 46 (two places) and terminal positioning holes 47 (two places). Regarding the fixing method, for example, the electrical contact base 11 is fixed by passing terminal connecting pins 48 provided on the ink supplying member 13 through terminal connecting holes 49 before caulking, while other fixing means can be used for fixing the base. A completed view is shown in FIG. 6.

Figure 7:
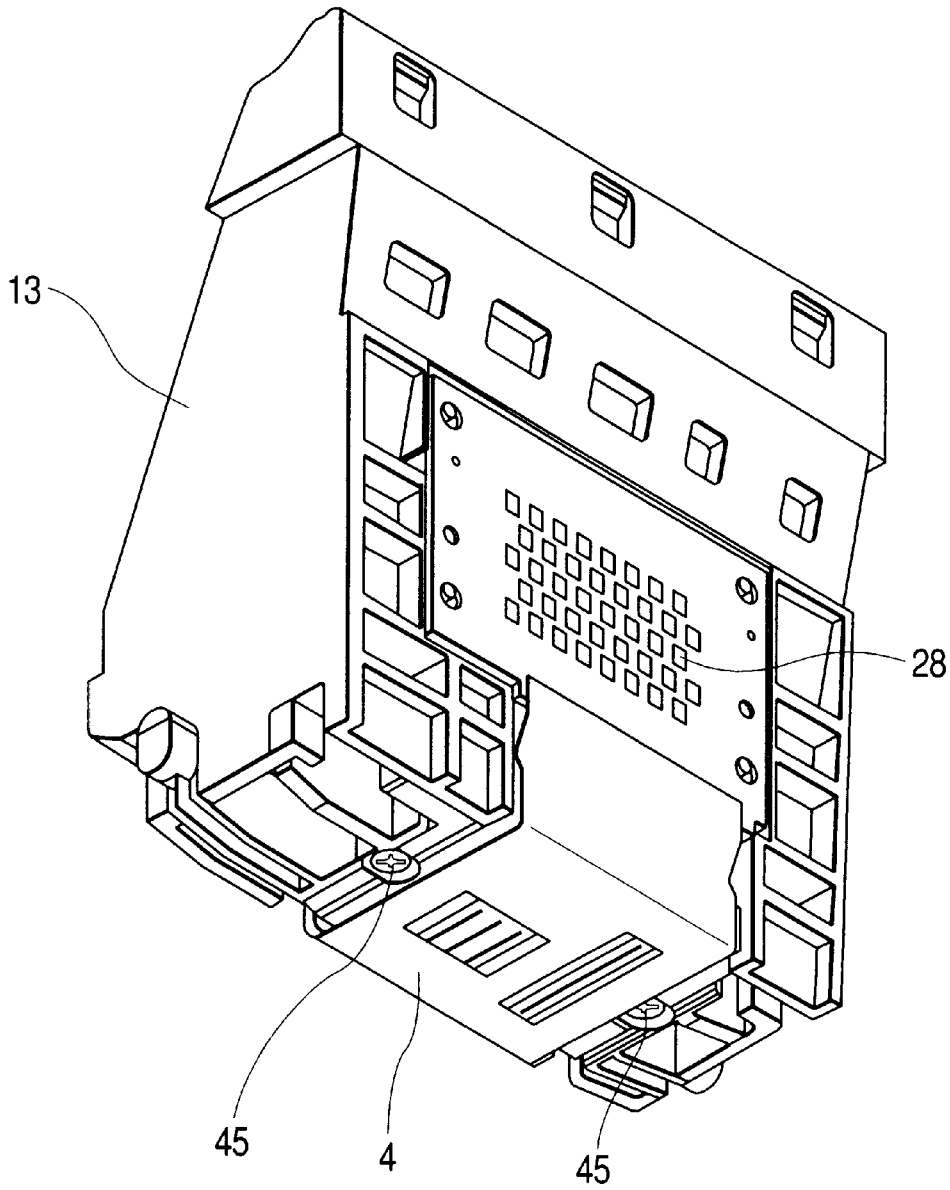
FIG. 7 is a perspective view showing a connection status of the ink supplying unit and the recording element unit shown in FIG. 3.
Figure 8:
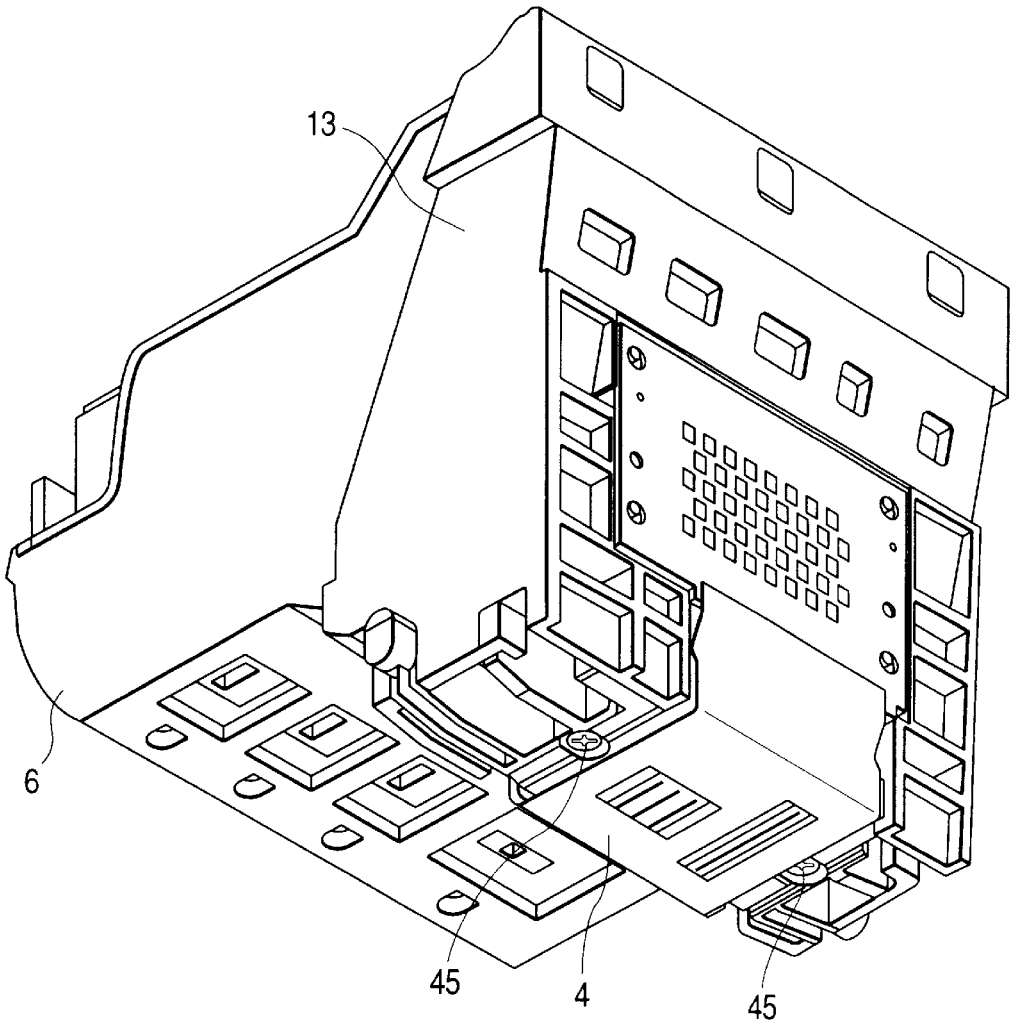
FIG. 8 is a perspective view showing a connection status of the ink supplying unit, the recording element unit, and the tank holder shown in FIG. 3.

Furthermore, a connection hole and a connected portion to the tank holder 6 of the ink supplying member 13 are fitted and connected to the tank holder 6, by which the recording head 2 is completed. The completed view is shown in FIG. 7.

(2) Description of Recording Head Cartridge

The above FIG. 1 and FIG. 2 are explanatory diagrams of mounting the recording head 2 and the ink tanks 3*a*, 3*b*, 3*c*, and 3*d* composing the recording head cartridge 1, with the corresponding color ink contained in the ink tanks 3*a*, 3*b*, 3*c*, and 3*d*. In addition, as shown in FIG. 5, each ink tank has an ink supplying aperture 50 for supplying the ink in the ink tank to the recording head 2. For example, when the ink tank 3 is mounted on the recording head 2, the ink supplying aperture 50 of the ink tank 3 is contacted with a pressure to the filter 34 provided in the joint portion 33 of the recording head 2, by which the black ink in the ink tank 3 is supplied to the recording element base 7 passing through the first plate 9 via the ink flow path 32 of the recording head 2 from the ink supplying aperture 50.

Then, the ink is supplied to a bubble chamber having the electrical heat converting elements 20 and the orifices 24 and then discharged toward a recording sheet which is a record medium by a heat energy given to the electrical heat converting elements 20.

Figure 9A:
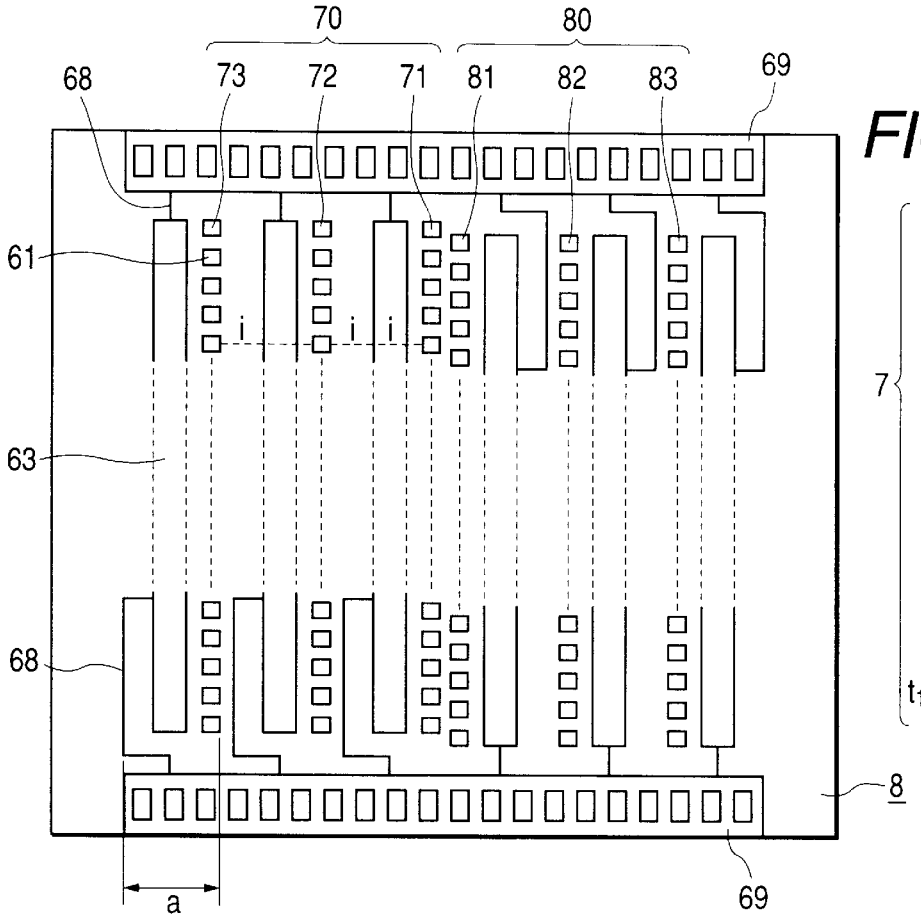
FIGS. 9A, 9B, and 9C are diagrams of assistance in explaining a configuration of the second recording element base shown in FIG. 3.
Figure 9B:
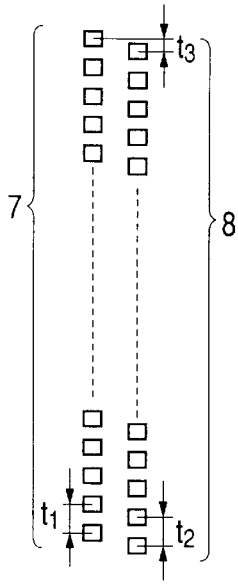
Figure 9C:
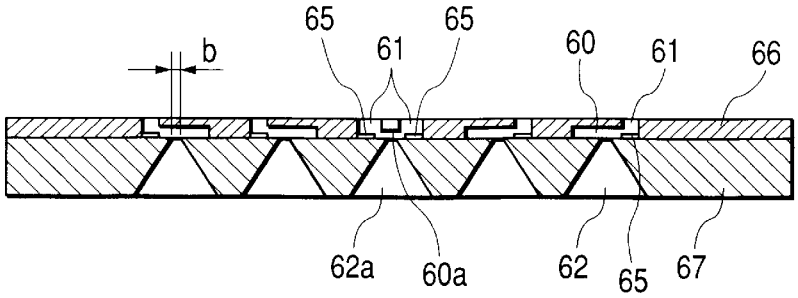

Subsequently, the second recording element base 8 is described in detail below. Referring to FIGS. 9A and 9B, there are shown plan views each showing a configuration of the second recording element base 8. Typically as shown in FIG. 9C, the second recording element base 8 comprises a base 67 including heat resistive elements 65 as energy converting elements and an orifice plate 66 for forming orifices 61. The base 67 is made of a silicon single crystal of a plane direction <100>. On the base 67, there are formed a plurality of strings (lines) of the heat resistive elements 65, transistors or other driver circuits 63 for driving the strings of the heat resistive elements 65, a contact pad 69 for a connection with the outside, and wiring 68 for connecting the driver circuits 63 to the contact pad 69 by using a semiconductor process.

The orifice plate 66 provided on the plate 67 is made of a photosensitive epoxy, the orifices 61 and the liquid flow paths 60 are formed correspondingly to the heat resistive elements 65 in a process as disclosed in Japanese Patent Laid-open Application No. 62-264957. In areas other than those of the above circuits 63, elements 65, and wiring 68 on the base 67, there are provided five through holes formed by anisotropic etching as disclosed in Japanese Patent Laid-open Application No. 9-11479, the through holes each forming ink supplying apertures 62 and 62*a* for supplying liquid. Furthermore, the ink supplying apertures 62 and 62*a* have communication with ink tanks of cyan (C), magenta (M), yellow (Y), magenta, and cyan, respectively, via the ink flow paths of the flow path forming member 14 of the ink supplying unit shown in FIG. 3.

Orifice 61 strings, heat resistive element 65 strings, and liquid flow path 60 strings are disposed on both side of the middle ink supplying aperture 62*a* and a orifice 61 string, a heat resistive element 65 string, and a liquid flow path 60 string are disposed in a single side of each of other ink supplying apertures 62. Furthermore, the ink supplying aperture and orifice strings, the heat resistive element strings, the liquid flow path strings, and the driver circuits other than the middle ones are disposed so as to be in a positional relationship between the left side and the right side of the base having a line of symmetry through the middle ink supplying apertures 62*a* (in other words, a relation of reflective symmetry). This arrangement enables the ink supplying apertures (through holes) and the driver circuits to be disposed on the base at regular intervals efficiently, thus achieving the minimum base size. In this embodiment, the total width of the nozzle, the driving transistor, and the wiring is 1.2 mm, a width of the through hole is 0.2 mm, and the base size is 1.2×6+0.2×5=8.2 mm. On the other hand, on the recording element base 7 for black ink as shown in FIG. 4, a single through hole is provided for a base and two orifice strings are disposed. The base size in this condition is 1.2×2+0.2=2.6 mm, and therefore if six sheets are used for a base for color ink as described in this embodiment, the base size is 2.6×6=15.6 mm. Even if a single orifice string is used instead of two strings, a size for a through hole formation is required and thus the base size cannot be reduced. The color recording element base 8 in this embodiment enables a capacity of a memory for retaining transfer data to the recording head to be reduced in proportion to the base size by decreasing the base size, thereby enabling the cost to be lowered.

In addition, six orifice strings (discharging portions) 71 to 73 and 81 to 83 almost parallel with each other are formed on the top surface of the recording element base 8 and the orifice strings 73, 72, 71, 81, 82, and 83 are used for discharging liquids of cyan, magenta, yellow, yellow, magenta, and cyan in this order, respectively. In this condition, in FIG. 9A, the ith orifices of the orifice strings 71 to 73 counted from the top of the drawing coincide with each other in a direction indicated by an arrow shown in FIG. 9A. In this manner, in a scanning direction in which the recording elements are scanned with being mounted on a recording apparatus described later, the orifice strings 71 to 73 are arranged so that the corresponding orifices coincide with each other and thus a first orifice string group 70 is formed. The orifice strings 81 to 83 are arranged in the same manner s for the orifice strings 71 to 73, and a second orifice string group 80 is formed by the orifice strings 81 to 83 so as to be adjacent to the fist orifice string group 70.

The first orifice string group 70 and the second orifice string group 80 are arranged with a difference of just a half of the orifice array pitch in a vertical scanning direction (in this embodiment, coinciding with an arrangement direction of the orifice strings) of the recording head so that respective orifices of the orifice strings 71 to 73 and 81 to 83 forming respective orifice groups complement each other in the scanning direction. This enables printing of high precision and fineness which is substantially twice that of the orifice array pitch.

Additionally, the recording element base 8 is capable of receiving a drive signal or the like from the recording apparatus when an external signal input terminal (see the reference numeral 28 in FIG. 7) coupled to this wiring plate is connected to an electrically connected portion of the recording apparatus by connecting the contact pad 69 to the electrode terminal (see the reference numeral 27 in FIG. 3) on the electrical wiring tape 10.

Subsequently, a recording method with this recording element base 8 is described below. In this embodiment, assuming that the heat emitting resistor has a size of 30 $\mu$m×30 $\mu$m, 128 heat emitting resistors are disposed for a single orifice string at 600 dpi and approx. 8 pl of ink is discharged from each nozzle (orifice) for recording. Two types of recording modes are used for the recording; a high-speed mode and a high resolution mode.

In the high-speed mode, a binary mode of 600 dpi is used for the recording in order to save time for image processing and data transfer. In this mode, two droplets are discharged for a single picture element (600×600 dpi) for printing a single color. Supposing that the nozzle strings are referred to as C1, M1, Y1, Y2, M2, and C2, for example, a droplet is discharged from each of the C1 and C2 nozzles to form an image for recording with cyan. Next, for printing of a secondary color, for example, green (G), a droplet is discharged from each nozzle of the C1, Y1, Y2, and C2 strings for a single picture element to form an image. For recording in the forward direction in the above, ink is attached to a record medium in an order of C(1), Y(1), Y(2), and C(2). For recording in the backward direction, ink is attached to the record medium in an order of C(2), Y(2), Y(1), and C(1). In both direction of the reciprocation, the attachment order of the ink is the same (CYYC), thus preventing color-shading from being caused by the reciprocation.

Next, in the high resolution mode, a single droplet is discharged for a single picture element (600×1200 dpi) for printing in a single color. First, an image area is masked and then picture elements for recording with a C1, M1, and Y1 nozzle string set are separated from picture elements for recording with a C2, M2, and Y2 nozzle string set before printing. For example, for printing in green, there are two types of picture elements mixed; picture elements for recording in C1 and Y1 (attached to paper in an order of C and Y) and those for recording in C2 and Y2 (attached to paper in an order of Y and C), though the color-shading is at an unnoticeable level due to uniform scattering of the picture elements.

As set forth in the above, a plurality of m nozzle strings (in this embodiment, m=6) are formed in parallel and there is a relation of m=n+1 where n designates the number of the plurality of supplying paths (in this embodiment, n=5), by which it becomes possible to provide color reciprocating color printing free from color-shading at a high speed and with the minimum head size. Furthermore, in this embodiment there is an effect of an easy control of printing timing since distances between adjacent nozzle strings are almost fixed. While three colors of C, M, and Y are used in this embodiment, the same effect is achieved when light cyan or light magenta is further added.

Figure 10A:
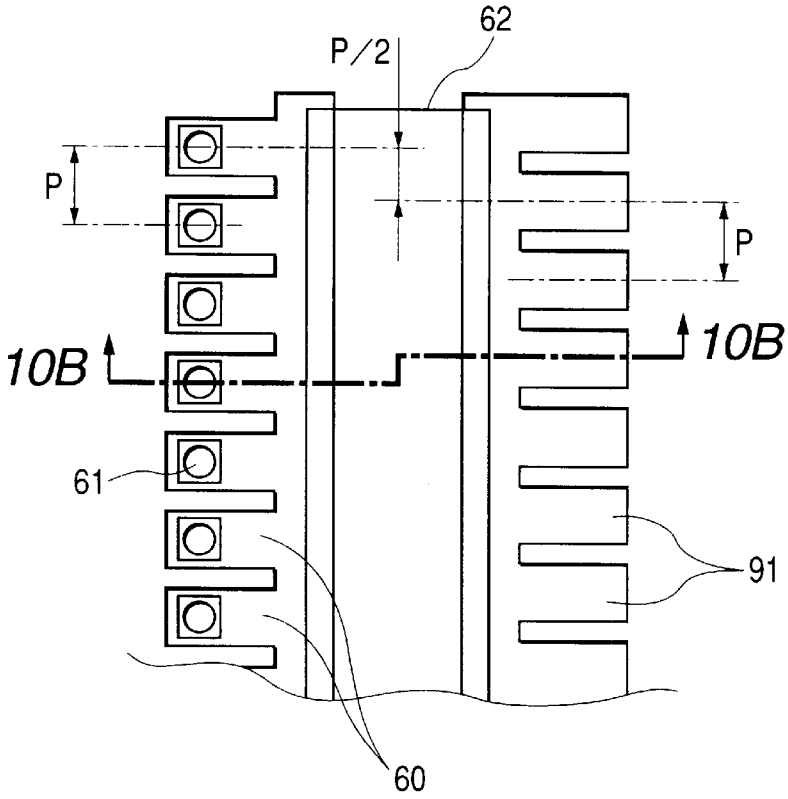
FIGS. 10A and 10B are detail views showing ink flow paths coupled to ink supplying apertures other than the middle one and their surroundings on the second recording element base shown in FIG. 3.
Figure 10B:
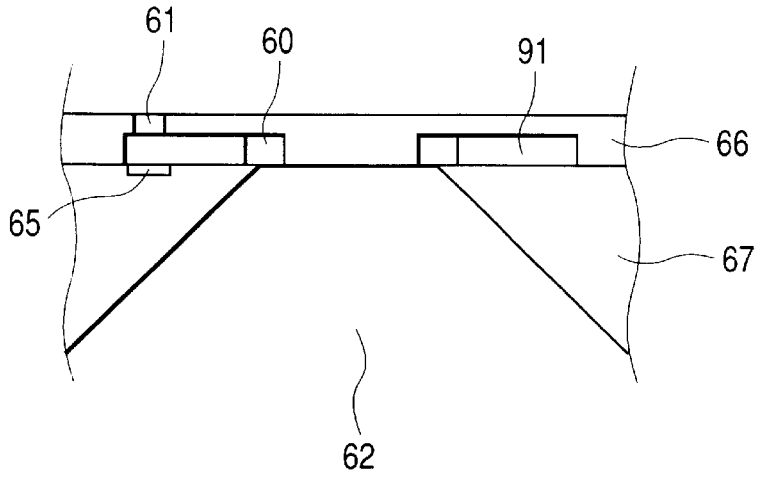
Figure 11A:
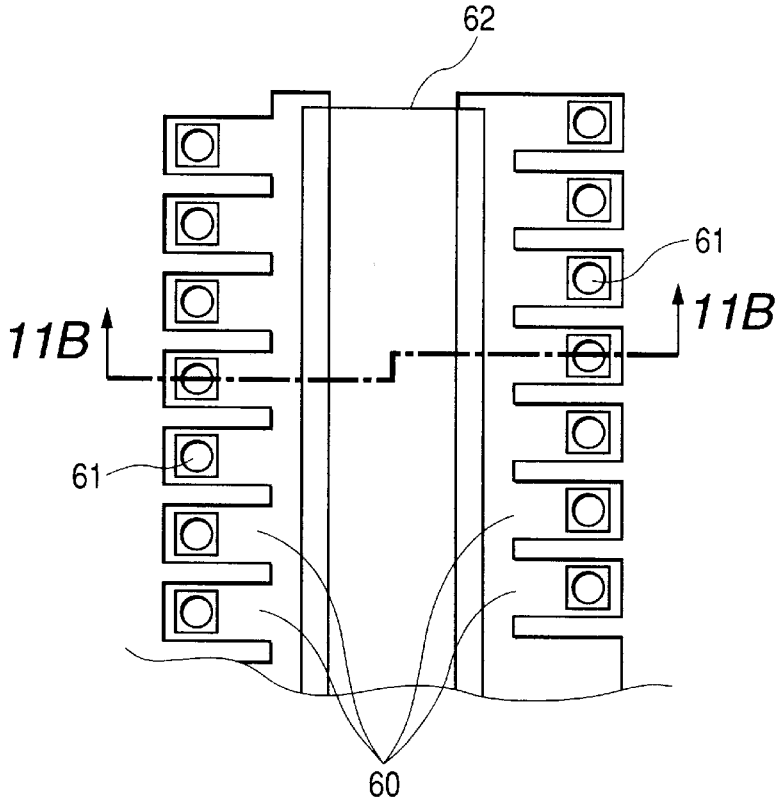
FIGS. 11A and 11B are detail views showing ink flow paths coupled to ink supplying apertures other than the middle one and their surroundings on the second recording element base shown in FIG. 3.
Figure 11B:
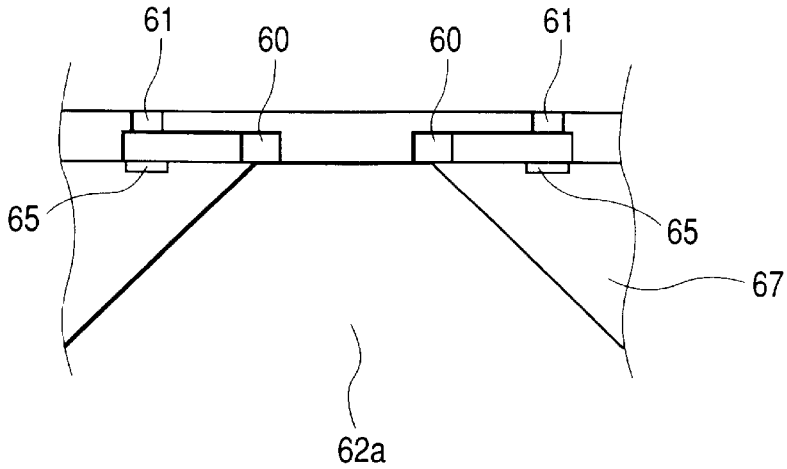

Furthermore, referring to FIGS. 10A and 10B and FIGS. 11A and 11B, there are shown ink flow paths and their surroundings on the second recording element base 8. More specifically, FIG. 10A, FIG. 10B, FIG. 11A, and FIG. 11B show a perspective diagram around the ink supplying aperture 62 other than the middle one on the base 8 in FIG. 8, a sectional view taken on line 10B–10B of FIG. 10A, a perspective diagram around the middle ink supplying aperture 62*a* on the base 8 in FIG. 8, and a sectional view taken on line 11B–11B of FIG. 11A, respectively. Referring to these drawings, the electrical heat converting elements 65 are formed on a surface of the base 67 and further a nozzle formation member made of a transparent resin to be an orifice plate 66 covers almost the entire surface of the base 67 including the ink supplying apertures 62. At an edge of the top of the ink supplying aperture 62 in the side of the liquid flow path 60, a nozzle formation member is hollowed so that the ink supplying aperture 62 has communication with the liquid flow path 60. On the other hand, at an edge of the top of the ink supplying aperture 62 in the opposite side of the flow path 60, the nozzle formation member is hollowed so as to form pectinate grooves as buffer chambers 91. Regarding the middle ink supplying aperture 62*a* shown in FIG. 12, however, the nozzle formation member is hollowed so as to have communication with the liquid flow path 60 strings in the both sides. The shape of the buffer chambers 91 are almost the same as that of the pectinate liquid flow paths 60 composed of a plurality of strings. Assuming that the pectinate groove has dimensions of 30 $\mu$m in width, 15 $\mu$m in height, and 50 $\mu$m in length, the pectinate groove string to be the buffer chambers 91 is arranged with a difference by a half pitch from the opposite liquid flow path string at 600 dpi as shown in FIG. 10A. The term "chamber" is used for meaning that it has closed portions except the portion having communication with the ink supplying apertures.

In this configuration, an air remains in the pectinate grooves as buffer chambers even if the ink supplying apertures 62 and the liquid flow paths 60 are filled with ink by providing the buffer chambers 91 in the opposite side to the orifice string with each ink supplying aperture string 72 therebetween, thereby attenuating pressure fluctuations inside the ink supplying apertures 62 caused by discharging droplets.

Figure 12:
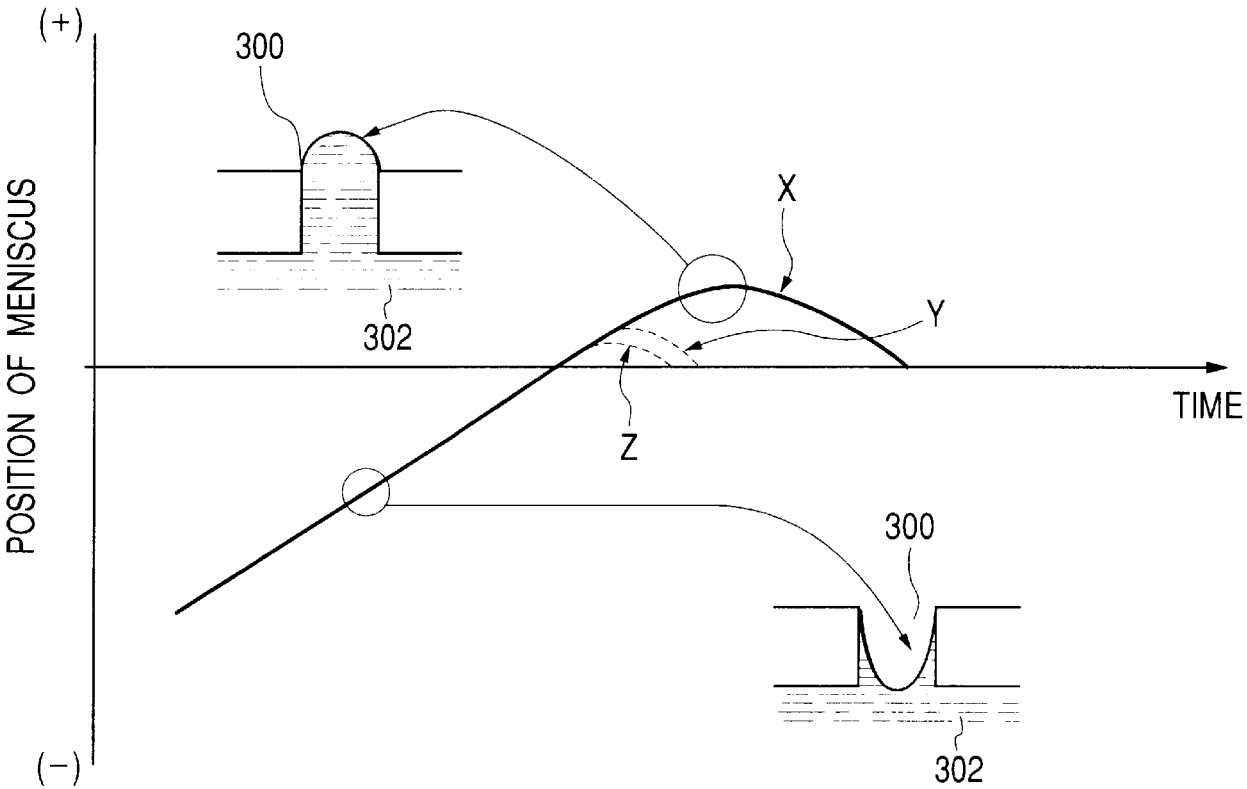
FIG. 12 is a graph showing a relation between a meniscus vibration observed when all the electrical heat converting elements (128 units) for cyan are driven at 15 kHz in the second recording element base shown in FIG. 3, for example, and a meniscus vibration in a conventional example for a comparison.

Referring to FIG. 12, in the recording element base 8 in this embodiment, there are shown a meniscus vibration generated when, for example, all the electrical heat converting elements (128 elements) for cyan are driven at 15 kHz and another meniscus vibration in the conventional apparatus for a comparison. In FIG. 12, there is also shown a meniscus vibration (Z) generated when only a single electrical heat converting element is driven in this embodiment. This diagram apparently shows that the meniscus vibration at the orifice 61 is suppressed. A meniscus vibration at droplet charging causes defectives such as a change of a droplet volume, a deviation in a discharging direction, and an increase of satellites (extremely minute drops around the main drops), thereby lowering an image quality. In this embodiment, however, an image keeps a high quality by the suppression of the meniscus vibration. In this diagram, reference numerals 300 and 302 designate an orifice and ink, respectively. A case in which no buffer chamber is provided is indicated by X and a case in which a buffer chamber is provided is indicated by Y.

For the middle ink supplying aperture 62*a* for yellow, there is not provided any buffer chamber 91, but a favorable image quality is achieved since yellow is visually unnoticeable regarding a change of an image in comparison with cyan and magenta.

Furthermore, in a third printing mode beside the above printing modes, droplets are attached to a record medium in an order of cyan, magenta, and yellow by using the orifice strings in the left half of the base in the forward direction and droplets are attached to the record medium in an order of cyan, magenta, and yellow as well by using the orifice strings in the right half of the base in the backward direction, thereby achieving recording having no color-shading at all, and only one of the two orifice strings is used in the forward or backward direction for the yellow droplets, by which the non-printing orifices act as vibration suppressing elements, thereby realizing stable discharging.

The pectinate grooves need not have the above dimensions necessarily if only it has a structure enabling an air to be kept stably. According to an investigation, it is found that an air can be kept stably if only the length is at least 3 times a smaller one of the width and the height. In addition, as for the number of grooves and its disposition pitch, the grooves may be disposed so that the meniscus vibration of each orifice is minimized and preferably the same number of grooves as for the liquid flow paths are disposed at the same pitch thereof. In addition, taking into consideration a case in which an air cannot be kept in the buffer chamber 91 or in which the buffer chamber cannot work normally due to dust clogging, the buffer chambers 91 are preferably disposed so as to match the middle of adjacent liquid flow paths 60, in other words, with a difference by a half pitch from the arrangement of the liquid flow paths 60, so that two buffer chambers 91 equally act on a single liquid flow path 60. Furthermore, if the liquid flow paths 60 and the orifice plate 66 including the buffer chambers are formed in a process disclosed in Japanese Patent Laid-open Application No. 62-264957, disposing the buffer chambers 91 having the same shape as for the liquid flow paths 60 at regular intervals relative to the middle of the ink supplying apertures (through holes) improves parallelism of the vicinity surface of the orifices to the base surface when the base is coated with an orifice plate formation resin. As for a formation method of the liquid flow paths 60 and the buffer chambers 91, the base is coated with a positive photosensitive resin, exposed and developed into shapes to be molds of the liquid flow paths 60 and the buffer chambers 91, and then coated with negative photosensitive resin so as to be optically hardened, and afterward the positive photosensitive resin is removed.

It is also possible to provide the buffer chambers with apertures having communication with the orifice surface like the orifices. In this case, however, there is a need for providing a mechanism for removing mixed ink which might be caused by a penetration of adjacent ink. Additionally, if a cost does not increase due to an enlargement of the base, mixed ink can be eliminated by providing each chamber with an electrical heat converting element.

[Second Embodiment]

This section describes only parts different from those of the configuration set forth in the first embodiment.

Figure 13A:
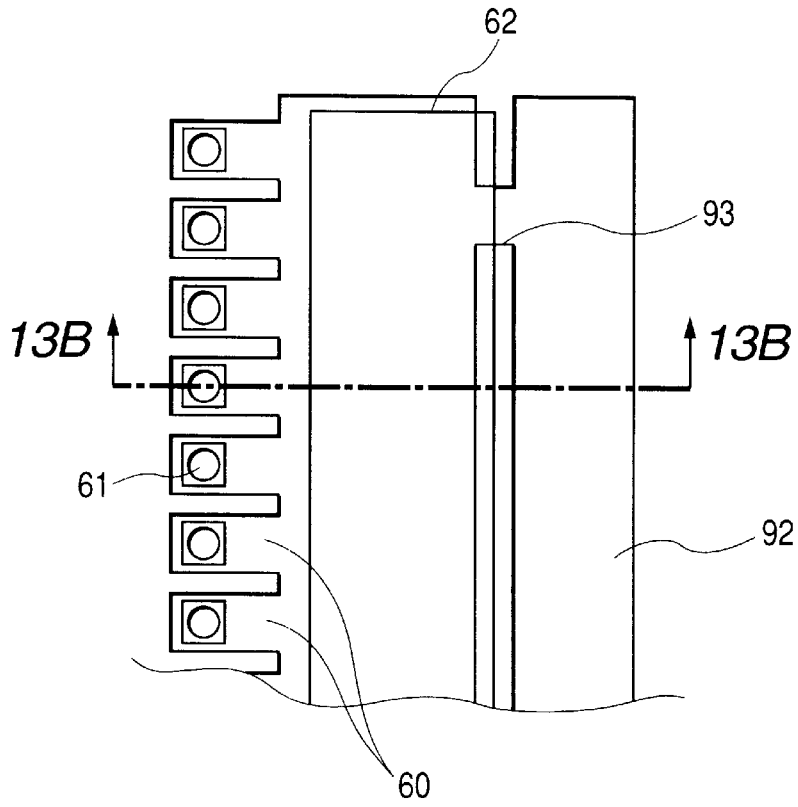
FIGS. 13A and 13B are diagrams showing modifications of the ink flow paths coupled to the ink supplying apertures other than the middle one on the second recording element base shown in FIG. 3 and its surroundings as a second embodiment of the present invention.
Figure 13B:
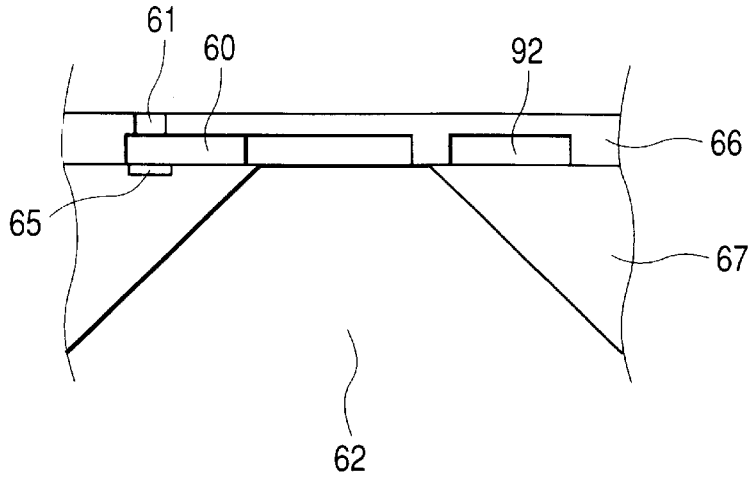

Referring to FIGS. 13A and 13B, there are shown modifications of the ink flow paths and their vicinity on the second recording element base 8 set forth in the above. In this embodiment, grooves are formed to be buffer chambers 92 in parallel to the orifice 61 and liquid flow path 60 strings on the orifice plate 66 on the base 67, having a configuration in which the buffer chambers have communication with the ink supplying apertures 62 through communication slots 93 at several places. The groove has dimensions of 50 $\mu$m in width, 15 $\mu$m in height, and 5 mm in length, while the communication slot 93 has dimensions of 30 $\mu$m in width and 15 $\mu$m in height and they are disposed at 300 $\mu$m intervals. According to this embodiment, an air is kept further stably, thereby securing a stability of discharging for a long period. Although the above groove is not limited to these dimensions, an oblong shape is preferable so as to keep a smaller base area. As for the number of the communication slots 93, if their quantity is too small, there are problems that an attenuation effect of the meniscus vibration is insufficient slot and that the attenuation effect depends upon a distance between the liquid flow path and the communication, and therefore it is preferable to provide a large number of communication slots.

[Third Embodiment]

This section also describes only parts different from those of the configuration set forth in the first embodiment. Particularly, the description will be made by giving various examples of providing buffer chambers regarding the middle ink supplying aperture 62*a* for yellow.

Figure 14A:
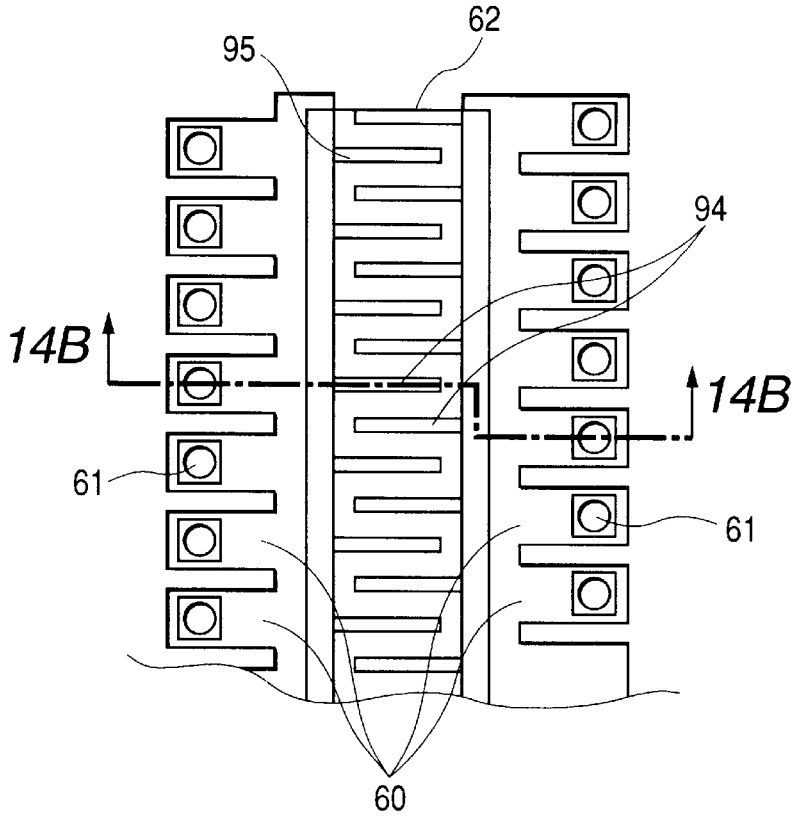
FIGS. 14A and 14B are diagrams showing modifications of the ink flow paths coupled to the ink supplying apertures other than the middle one on the second recording element base shown in FIG. 3 and its surroundings as a third embodiment of the present invention.
Figure 14B:
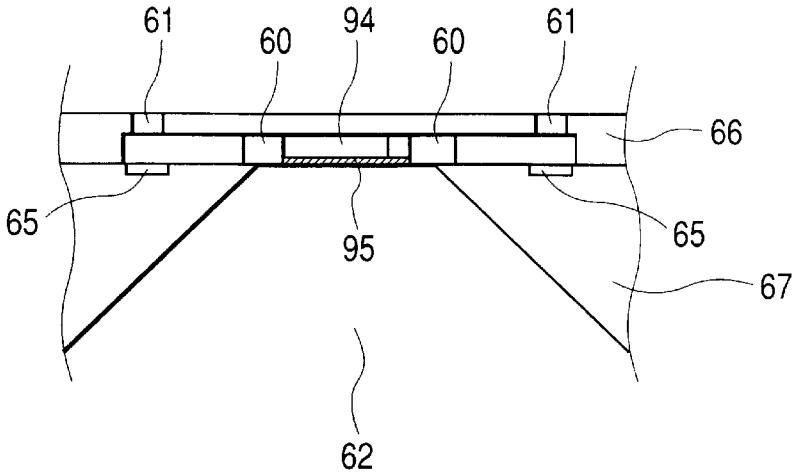

FIGS. 14A and 14B show modifications as a third embodiment of ink flow paths and their vicinity on the second recording element base 8 set forth in the first embodiment. In this embodiment, grooves corresponding to liquid flow paths 60 are formed by providing a pectinate pattern on a nozzle formation member at the top of the middle ink supplying apertures 62 shown in FIG. 11 and buffer chambers 94 are formed by covering bottoms of all the grooves with a thin film member 95. This configuration assures a stability of discharging for, for example, yellow ink in the middle portion. For example, the above groove has dimensions of 20 $\mu$m in width, 15 $\mu$m in height, and 50 $\mu$m in depth and there are provided buffer chambers 94 having openings in the opposite side to respective liquid flow paths 60 in both sides of the ink supplying apertures 62.

Figure 15A:
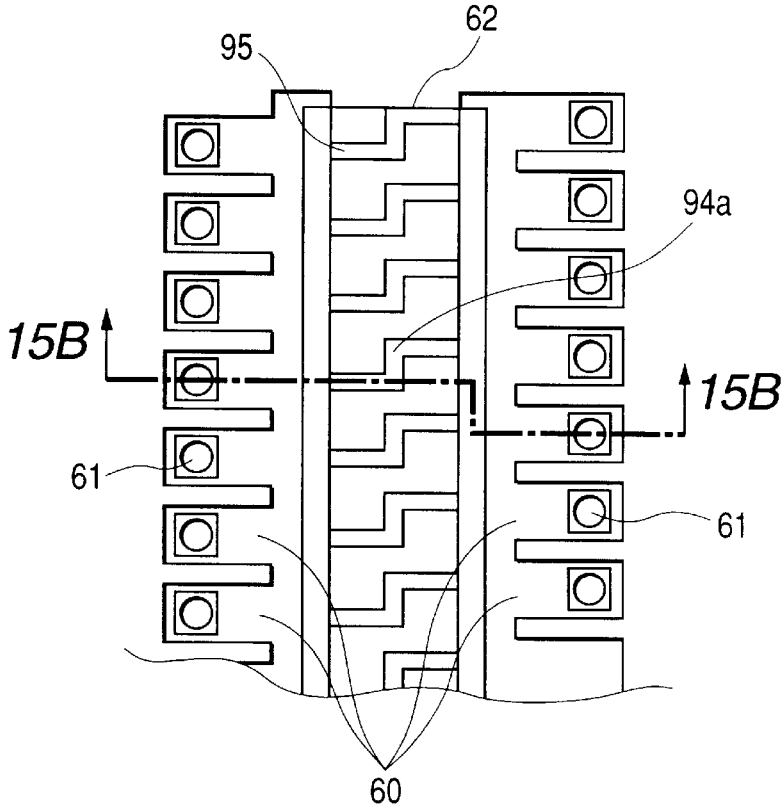
FIGS. 15A and 15B are diagrams showing modifications of the embodiment shown in FIGS. 14A and 14B.
Figure 15B:
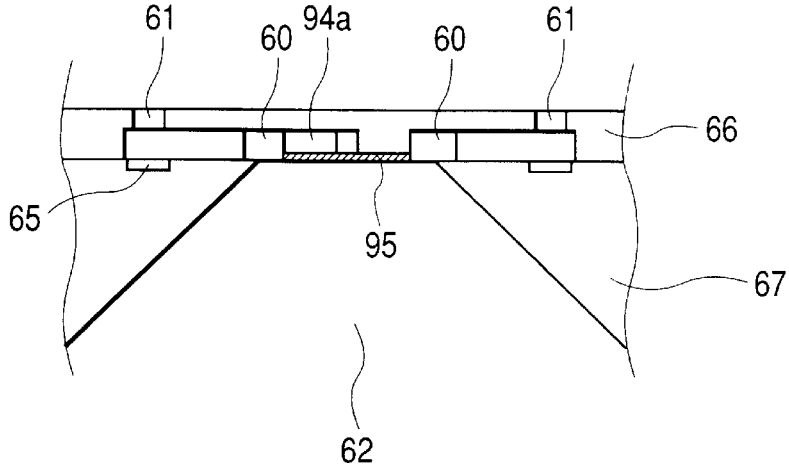

Referring to FIGS. 15A and 15B, there are shown modifications of the above embodiment. In examples shown in these diagrams, buffer chambers 94*a* are formed with adjacent grooves connected with each other for communication, thereby reducing the number of the grooves to increase a mechanical strength of the nozzle formation member.

Figure 16A:
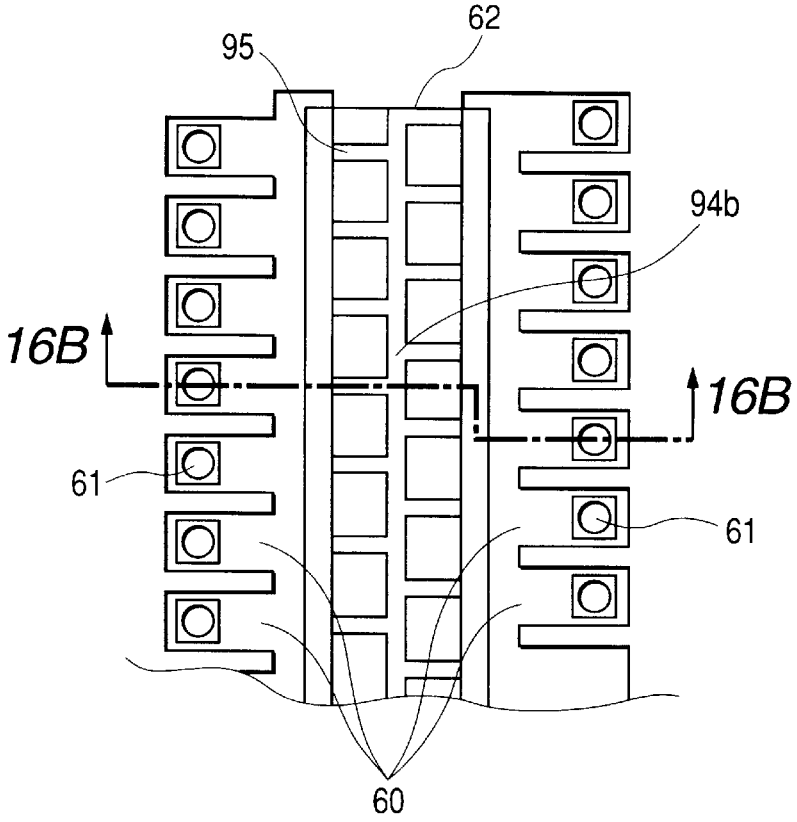
FIGS. 16A and 16B are diagrams showing further modifications of the buffer chambers shown in FIGS. 15A and 15B.
Figure 16B:
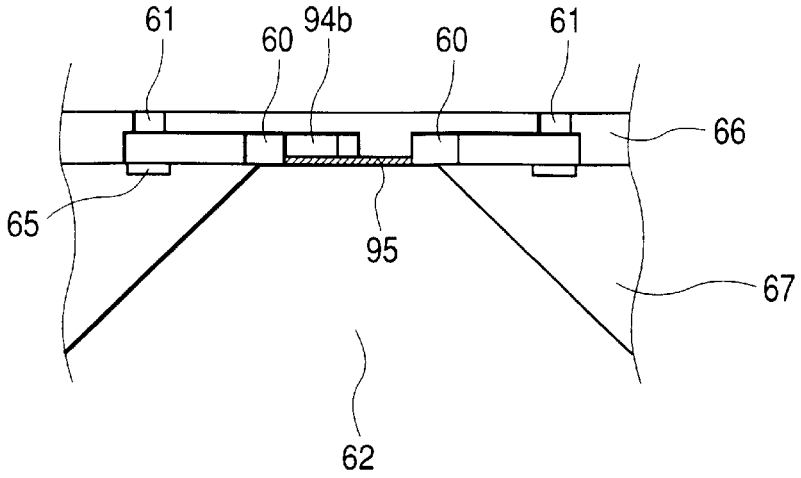

Referring to FIGS. 16A and 16B, there are shown further modifications of the buffer chambers shown in FIGS. 15A and 15B. In examples shown in these diagrams, buffer chambers 94*b* are formed by providing grooves parallel to an orifice string in addition to the example shown in FIG. 4, thereby enabling an air in the buffer chambers to be kept more stably.

Figure 17A:
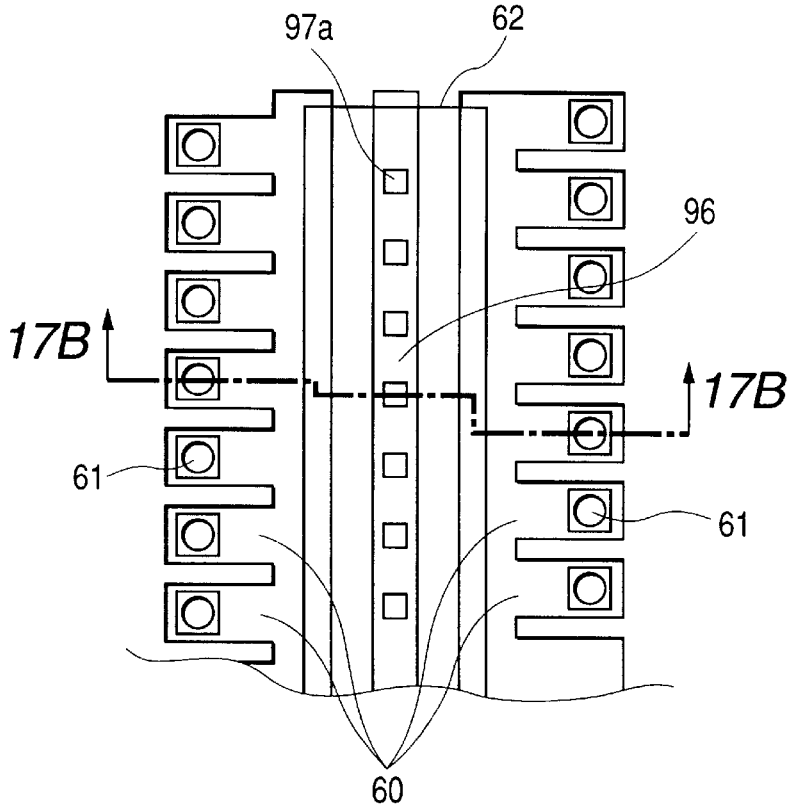
FIGS. 17A and 17B are diagrams other modifications of the embodiment shown in FIGS. 14A and 14B.
Figure 17B:
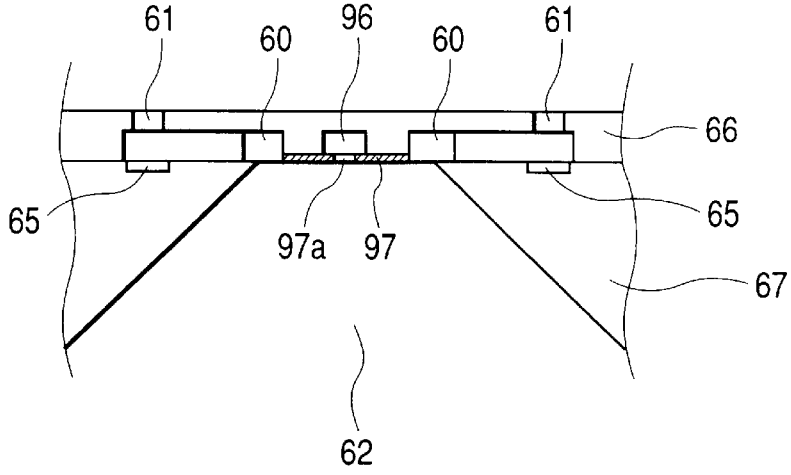

Referring to FIGS. 17A and 17B, there are shown other modifications of the embodiment shown in FIGS. 14A and 14B. In an example shown in this diagram, buffer chambers 96 are formed by providing grooves parallel to an orifice 61 string on a nozzle formation member at the top of the middle ink supplying apertures 62 shown in FIGS. 11A and 11B, covering these grooves with a thin film member 97, and providing apertures 97*a* at a desired pitch on the thin film member 97. This configuration enables a width of the buffer chamber and a base size to be minimized.

[Other Embodiments]

Figure 18:
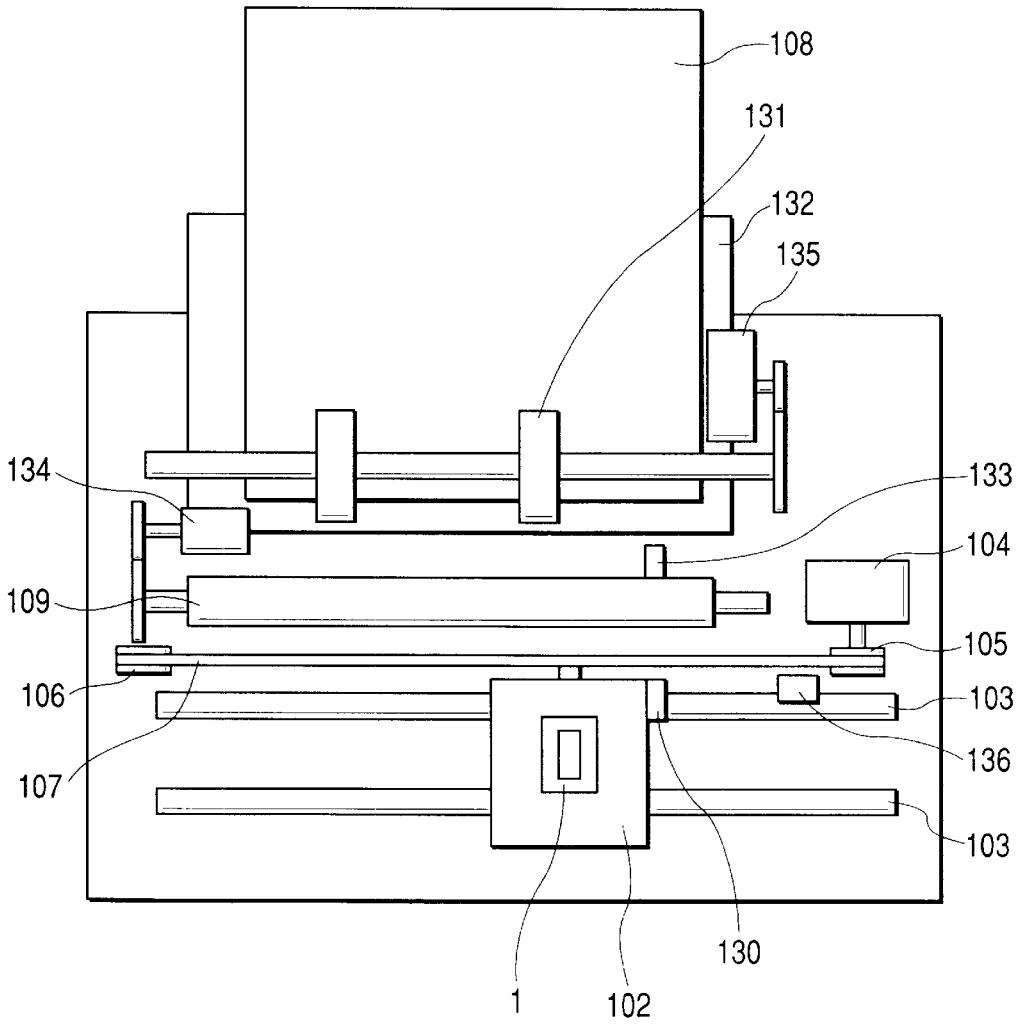
FIG. 18 is an explanatory diagram showing an example of a recording apparatus on which a liquid discharge recording head according to the present invention can be mounted.
Figure 19:
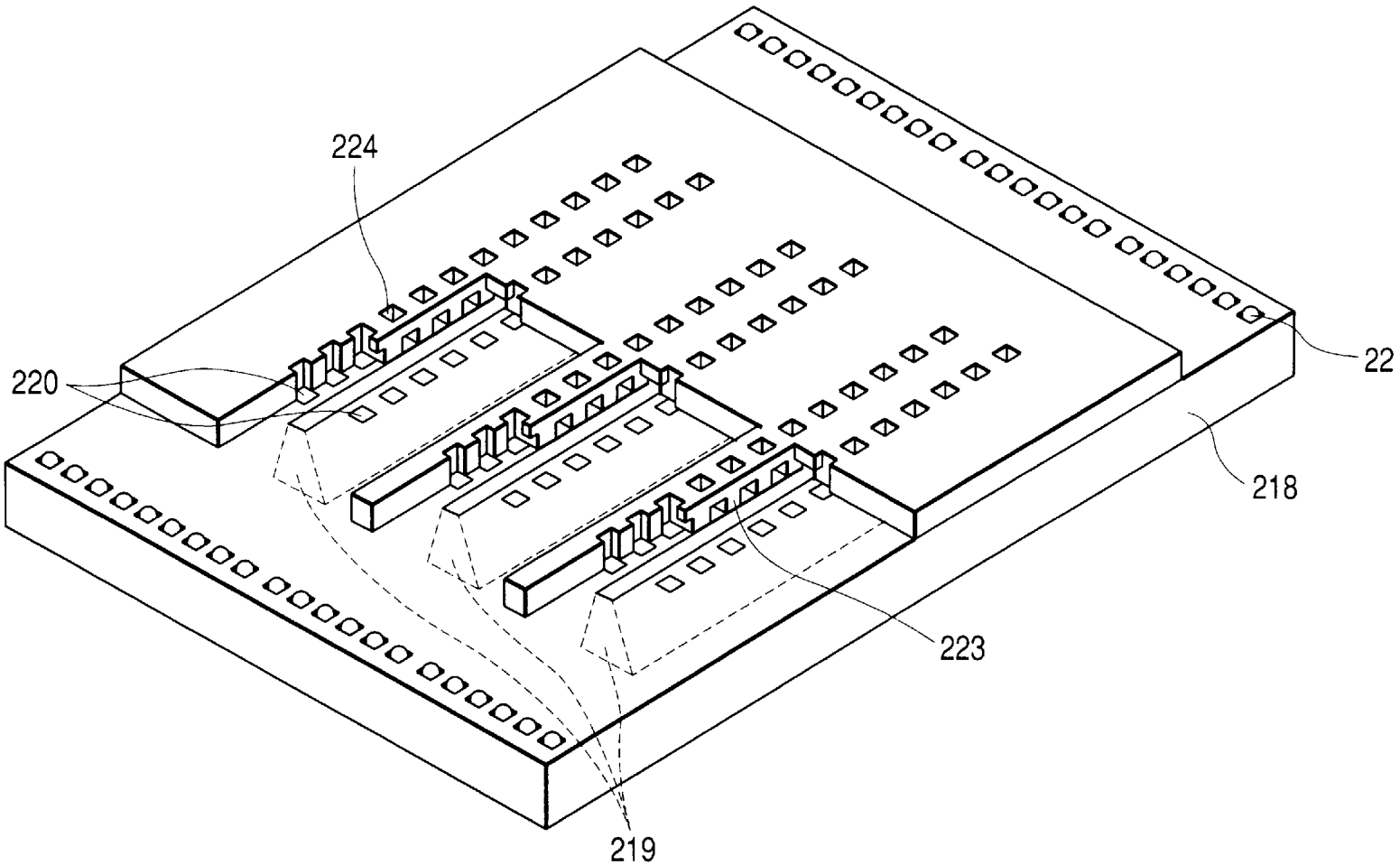
FIG. 19 is a configuration diagram of a general color-ink-jet recording head.

Finally, a description will be made for a liquid discharge recording apparatus on which the above cartridge type recording head can be mounted. Referring to FIG. 18, there is shown an explanatory diagram illustrating an example of a recording apparatus on which a liquid discharge recording head according to the present invention can be mounted.

In the recording apparatus shown in FIG. 18, the head cartridge 1 shown in FIG. 1 is positioned and mounted on a carriage 102 so as to be exchangeable and the carriage 102 is provided with an electrically connected portion for transmitting a drive signal or the like to each discharging portion via an external signal input terminal (See the reference numeral 28 in FIG. 6) on the cartridge 1.

The carriage 102 is guided and supported with being capable of a reciprocating motion along a guide shaft 103 installed in the apparatus with extending in the main scanning direction. The carriage 102 is driven via a driving mechanism including a motor pulley 105, a follower pulley 106, and a timing belt 107 and its position and movement are controlled by means of a main scanning motor 104. In addition, the carriage 102 is provided with a home position sensor 130. This enables the current position to be detected when the home position sensor 130 on the carriage 102 passes by a position of a shielding sheet 136.

A record medium 108 such as a print form or a plastic thin plate is separated from others and fed one by one from an automatic sheet feeder (hereinafter, ASF) by rotating a pickup roller 131 via a gear from a feeding motor 135. Furthermore, a rotation of a carrying roller 109 delivers (vertical scanning) the medium after passing by the position (printed portion) opposite to an orifice surface of the head cartridge 1. The carrying roller 109 is rotated by a rotation of an LF motor 134 via a gear. In this operation, whether a sheet feed is completed is determined and a head location at the sheet feed is decided when the record medium 108 passes by a paper end sensor 133. Furthermore, the paper end sensor 133 is used to find where a rear end of the record medium 108 actually exists and to finally calculate the current recording position from the actual rear end.

The record medium 8 is supported by a platen (not shown) on its rear surface so as to form a flat printing surface in the printed portion. In this embodiment, the head cartridge 1 mounted on the carriage 102 is held so as to be parallel to the record medium 108 between two pairs of the carrying rollers with the orifice surface extruding downward from the carriage 102.

The head cartridge 1 is mounted on the carriage 102 so that the orifices in each orifice portion are arranged in a direction crossing the scanning direction of the carriage 102 and is used for recording by discharging liquids from the orifice strings.

As set forth hereinabove, the present invention comprises a plurality of strings of orifices corresponding to a plurality of recording liquids, a plurality of liquid flow paths and electrical heat converting elements corresponding to the plurality of orifice strings, and a plurality of liquid supplying apertures for supplying the liquids to the plurality of liquid flow path strings, wherein the colors of the liquids supplied to the liquid supplying apertures are arranged so that liquids having the same color are symmetrical about the middle of the head, by which the order of colors for implanting droplets in a record medium is the same for recording in both of the forward and backward directions so as to prevent color-shading, thereby increasing a recording speed by applying bidirectional recording.

In addition, by disposing liquid supplying apertures other than the middle one of the plurality of liquid supplying apertures for supplying liquids to the plurality of liquid flow path strings, orifice strings, heat resistance element strings, liquid flow path strings, and driver circuits so as to have line symmetry around the middle ink supplying aperture, the liquid supplying apertures and the driver circuits can be disposed at regular intervals on the base efficiently, thus enabling a size of the base to be minimized. The reduction of the base size lowers a capacity of a memory for retaining transfer data to the recording head proportionally to the base size, thus enabling the cost to be lowered.

Particularly, according to the present invention, buffer chambers are provided on the same plane as for the above liquid flow paths with being in contact with the liquid supplying apertures, an air remains in the buffer chambers even in a condition in which the liquid supplying apertures and the liquid flow paths are filled with liquids, thereby enabling an attenuation of pressure fluctuations inside the liquid supplying apertures caused by discharging droplets. This reduces a meniscus vibration at driving a discharge, thereby enabling a high-quality image to be maintained.

What is claimed is:

1. A liquid discharge recording head, comprising a plurality of orifice lines each having a plurality of orifices arranged correspondingly to respective recording liquids for discharging the recording liquids of a plurality of colors, a plurality of liquid flow paths and electric thermal converting elements corresponding to the plurality of orifices, and a plurality of liquid supplying apertures arranged along said orifice lines for supplying said recording liquids of the plurality of colors to said plurality of liquid flow paths, wherein the orifice lines corresponding to the recording liquids of the plurality of colors are symmetrically arranged about the head scanning direction regarding the same color of the recording liquids and said head has a plurality of chambers having communication with said liquid flow paths in the opposite side of said orifice lines with said liquid supplying apertures therebetween, and further comprising an odd number of said liquid supplying apertures and an even number of said orifice lines, wherein the middle liquid supplying apertures of said plurality of liquid supplying apertures are disposed between the orifices, the electric thermal converting elements, and the liquid flow paths and wherein other liquid supplying apertures are disposed with orifices, electric thermal converting elements, and liquid flow paths arranged in a single side of those liquid supplying apertures, wherein said orifice lines are almost line-symmetrically about the middle liquid supplying apertures, and wherein the ith orifices counted from each end of said orifice lines belonging to a left half or a right half of the middle liquid supplying apertures are disposed on a single line and the ith orifice in the left half and the ith orifice in the right half are disposed with a difference by a half pitch in the column direction.

2. A liquid discharge recording head according to claim 1, wherein a driver circuit for a driving control of each electric thermal converting element is disposed for each electric thermal converting element corresponding to said orifice line.

3. A liquid discharge recording head according to claim 2, wherein the number of said chambers is equal to the number of said liquid flow paths.

4. A liquid discharge recording head according to claim 3, wherein a pitch of said chambers adjacent to each other is the same as a pitch of said liquid flow paths adjacent to each other and said chambers are opposite to said liquid flow paths and disposed with a half-pitch difference relative to said liquid flow paths.

5. A liquid discharge recording head according to claim 4, wherein a shape of said chamber is almost the same as that of said liquid flow path.

6. A liquid discharge recording head according to one of claims 2 to 5, wherein said chambers have communication with the liquid supplying apertures other than the middle liquid supplying aperture.

7. A liquid discharge recording head according to claim 6, wherein said liquid flow paths and said chambers are formed by coating the base with a positive photosensitive resin, exposing and developing it to shapes of molds of said liquid flow paths and said chambers, coating it with a negative photosensitive resin, and then removing said positive photosensitive resin.

8. A liquid discharge recording apparatus, which has a carriage for detachably mounting a liquid discharge recording head according to claim 7, for recording on a record medium by discharging droplets from a desired orifice string of the liquid discharge recording head with a scanning of the carriage.

9. A liquid discharge recording apparatus, which has a carriage for detachably mounting a liquid discharge recording head according to claim 6, for recording on a record medium by discharging droplets from a desired orifice string of the liquid discharge recording head with a scanning of the carriage.

10. A liquid discharge recording head according to one of claims 2 to 5, wherein said chambers form grooves each having a desired shape in a portion in contact with the middle liquid supplying aperture of a member forming said liquid flow paths and are formed by covering these grooves with a thin film member.

11. A liquid discharge recording head according to claim 10, wherein said liquid flow paths and said chambers are formed by coating the base with a positive photosensitive resin, exposing and developing it to shapes of molds of said liquid flow paths and said chambers, coating it with a negative photosensitive resin, and then removing said positive photosensitive resin.

12. A liquid discharge recording apparatus, which has a carriage for detachably mounting a liquid discharge recording head according to claim 11, for recording on a record medium by discharging droplets from a desired orifice string of the liquid discharge recording head with a scanning of the carriage.

13. A liquid discharge recording apparatus, which has a carriage for detachably mounting a liquid discharge recording head according to claim 10, for recording on a record medium by discharging droplets from a desired orifice string of the liquid discharge recording head with a scanning of the carriage.

14. A liquid discharge recording head according to one of claims 1 and 2–5, wherein there are at least three colors of cyan, magenta, and yellow for said plurality of recording liquid colors and the yellow ink is supplied to the middle liquid supplying aperture among the plurality of liquid supplying apertures.

15. A liquid discharge recording head according to claim 14, wherein said chambers have communication with the liquid supplying apertures other than the middle liquid supplying aperture.

16. A liquid discharge recording head according to claim 15, wherein said liquid flow paths and said chambers are formed by coating the base with a positive photosensitive resin, exposing and developing it to shapes of molds of said liquid flow paths and said chambers, coating it with a negative photosensitive resin, and then removing said positive photosensitive resin.

17. A liquid discharge recording apparatus, which has a carriage for detachably mounting a liquid discharge recording head according to claim 16, for recording on a record medium by discharging droplets from a desired orifice string of the liquid discharge recording head with a scanning of the carriage.

18. A liquid discharge recording apparatus, which has a carriage for detachably mounting a liquid discharge recording head according to claim 15, for recording on a record medium by discharging droplets from a desired orifice string of the liquid discharge recording head with a scanning of the carriage.

19. A liquid discharge recording head according to claim 14, wherein said chambers form grooves each having a desired shape in a portion in contact with the middle liquid supplying aperture of a member forming said liquid flow paths and are formed by covering these grooves with a thin film member.

20. A liquid discharge recording head according to claim 19, wherein said liquid flow paths and said chambers are formed by coating the base with a positive photosensitive resin, exposing and developing it to shapes of molds of said liquid flow paths and said chambers, coating it with a negative photosensitive resin, and then removing said positive photosensitive resin.

21. A liquid discharge recording apparatus, which has a carriage for detachably mounting a liquid discharge recording head according to claim 20, for recording on a record medium by discharging droplets from a desired orifice string of the liquid discharge recording head with a scanning of the carriage.

22. A liquid discharge recording apparatus, which has a carriage for detachably mounting a liquid discharge recording head according to claim 19, for recording on a record medium by discharging droplets from a desired orifice string of the liquid discharge recording head with a scanning of the carriage.

23. A liquid discharge recording head according to claim 14, wherein said liquid flow paths and said chambers are formed by coating the base with a positive photosensitive resin, exposing and developing it to shapes of molds of said liquid flow paths and said chambers, coating it with a negative photosensitive resin, and then removing said positive photosensitive resin.

24. A liquid discharge recording apparatus, which has a carriage for detachably mounting a liquid discharge recording head according to claim 23, for recording on a record medium by discharging droplets from a desired orifice string of the liquid discharge recording head with a scanning of the carriage.

25. A liquid discharge recording apparatus, which has carriage for detachably mounting a liquid discharge recording head according to claim 14, for recording on a record medium by discharging droplets from a desired orifice string of the liquid discharge recording head with a scanning of the carriage.

26. A liquid discharge recording head according to one of claims 1 and 2–5 wherein said liquid flow paths and said chambers are formed by coating the base with a positive photosensitive resin, exposing and developing it to shapes of molds of said liquid flow paths and said chambers, coating it with a negative photosensitive resin, and then removing said positive photosensitive resin.

27. A liquid discharge recording apparatus, which has a carriage for detachably mounting a liquid discharge recording head according to claim 26, for recording on a record medium by discharging droplets from a desired orifice string of the liquid discharge recording head with a scanning of the carriage.

28. A liquid discharge recording apparatus, which has a carriage for detachably mounting a liquid discharge recording head according to one of claims 1 and 2–5, for recording on a record medium by discharging droplets from a desired orifice string of the liquid discharge recording head with a scanning of the carriage.

* * * * *

UNITED STATES PATENT AND TRADEMARK OFFICE

CERTIFICATE OF CORRECTION

PATENT NO. : 6,575,560 B2
DATED : June 10, 2003
INVENTOR(S) : Mineo Kaneko et al.

It is certified that error appears in the above-identified patent and that said Letters Patent is hereby corrected as shown below:

Column 9,
Line 30, “s” should read -- as --; and
Line 33, “fist” should read -- first --.

Column 14,
Line 39, “an” should read -- and --.

Column 16,
Line 13, “claims 1 and 2-5,” should read -- claims 1-5, --.

Column 17,
Line 19, “claims 1 and 2-5” should read -- claims 1-5, --.

Column 18,
Line 14, “claims 1 and 2-5,” should read -- claims 1-5, --.

Signed and Sealed this

Sixteenth Day of December, 2003

JAMES E. ROGAN
*Director of the United States Patent and Trademark Office*